US009834288B1

(12) United States Patent
Heinen

(10) Patent No.: US 9,834,288 B1
(45) Date of Patent: Dec. 5, 2017

(54) HYDRAULIC DRIVES FOR USE IN CHARGING SYSTEMS, BALLAST SYSTEMS, OR OTHER SYSTEMS OF UNDERWATER VEHICLES

(71) Applicant: Raytheon Company, Waltham, MA (US)

(72) Inventor: Gregory W. Heinen, Lowell, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/173,214

(22) Filed: Jun. 3, 2016

(51) Int. Cl.

| | |
|---|---|
| ***B63G 8/14*** | (2006.01) |
| ***B63G 8/00*** | (2006.01) |
| ***B63H 19/00*** | (2006.01) |
| ***B63H 25/38*** | (2006.01) |

(52) U.S. Cl.
CPC ..... *B63G 8/14* (2013.01); *B63G 8/001* (2013.01); *B63H 19/00* (2013.01); *B63H 25/38* (2013.01); *B63G 2008/002* (2013.01)

(58) Field of Classification Search
CPC ..... B63G 8/14; B63G 8/001; B63H 19/00; B63H 25/38
USPC ..... 114/125
See application file for complete search history.

(56) References Cited

U.S. PATENT DOCUMENTS

| | | | |
|---|---|---|---|
| 952,452 | A | 5/1910 | Leon |
| 1,315,267 | A | 9/1919 | White |
| 1,361,561 | A | 12/1920 | Yancey |
| 1,421,369 | A | 7/1922 | Ardo |
| 1,710,670 | A | 11/1925 | Bonney |
| 2,000,746 | A | 5/1935 | Dray |
| 2,381,478 | A | 9/1942 | Zukor |
| 2,537,929 | A | 1/1951 | Daly et al. |
| 2,642,693 | A | 6/1953 | Broady |
| 2,720,367 | A | 10/1955 | Doolittle |

(Continued)

FOREIGN PATENT DOCUMENTS

| | | | |
|---|---|---|---|
| EP | 2660433 | A1 | 11/2013 |
| EP | 2698506 | A1 | 2/2014 |

(Continued)

OTHER PUBLICATIONS

U.S. Appl. No. 11/081,092, filed Aug. 25, 1914, Gustav M. LaGergren.

(Continued)

*Primary Examiner* — Stephen Avila

(57) ABSTRACT

An apparatus includes first and second tanks each configured to receive and store a refrigerant under pressure. The apparatus also includes at least one generator configured to receive flows of the refrigerant between the tanks and to generate electrical power based on the flows of the refrigerant. The apparatus further includes first and second hydraulic drives associated with the first and second tanks, respectively. Each hydraulic drive includes a first piston within the associated tank, a channel fluidly coupled to the associated tank and configured to contain hydraulic fluid, and a second piston within the channel and configured to move within the channel in order to vary an amount of the hydraulic fluid within the associated tank and vary a position of the first piston within the associated tank. The channel of each hydraulic drive has a cross-sectional area that is less than a cross-sectional area of the associated tank.

20 Claims, 16 Drawing Sheets

(56) References Cited

U.S. PATENT DOCUMENTS

| | | | | |
|---|---|---|---|---|
| 2,750,794 | A | 6/1956 | Downs | |
| 2,783,955 | A | 3/1957 | Fitz Patrick | |
| 2,823,636 | A | 2/1958 | Gongwer | |
| 2,826,001 | A | 3/1958 | Presnell | |
| 2,845,221 | A | 7/1958 | Vine et al. | |
| 2,964,874 | A | 12/1960 | Armando | |
| 3,157,145 | A | 11/1964 | Farris et al. | |
| 3,698,345 | A * | 10/1972 | Kreitner | B63B 39/03 114/125 |
| 3,818,523 | A | 6/1974 | Stillman | |
| 4,445,818 | A * | 5/1984 | Ohsaki | B62D 5/32 417/288 |
| 4,577,583 | A | 3/1986 | Green, II | |
| 4,850,551 | A | 7/1989 | Krawetz et al. | |
| 4,919,637 | A | 4/1990 | Fleischmann | |
| 5,134,955 | A | 8/1992 | Manfield | |
| 5,291,847 | A | 3/1994 | Webb | |
| 5,303,552 | A | 4/1994 | Webb | |
| 5,615,632 | A | 4/1997 | Nedderman, Jr. | |
| 6,263,819 | B1 | 7/2001 | Gorustein et al. | |
| 6,328,622 | B1 | 12/2001 | Geery | |
| 2007/0186553 | A1 | 8/2007 | Lin | |
| 2008/0088171 | A1 * | 4/2008 | Cheng | E21B 41/0064 299/10 |
| 2010/0327605 | A1 | 12/2010 | Andrews | |
| 2011/0101579 | A1 * | 5/2011 | Polakowski | B60G 15/12 267/64.26 |
| 2012/0091942 | A1 | 4/2012 | Jones et al. | |

FOREIGN PATENT DOCUMENTS

| | | | |
|---|---|---|---|
| GB | 235363 | A | 6/1925 |
| GB | 541775 | A | 12/1941 |
| GB | 658070 | A | 10/1951 |
| GB | 2422877 | A | 8/2006 |
| WO | 2011000062 | A1 | 1/2011 |

OTHER PUBLICATIONS

Jack A. Jones et al., "Novel Thermal Powered Technology for UUV Persistant Surveillance", California Institute of Technology, Feb. 10, 2006, 11 pages.

Terry Huntsberger et al., "Slocum-TREC Thermal Glider", California Institute of Technology, Jan. 31, 2012, 16 pages.

Terry Huntsberger et al., "Advanced Energy Storage System for Thermal Engines", California Institute of Technology, Jan. 31, 2013, 16 pages.

Yi Chao, "Diurnal Variability Part I: Global 1-km SST (G1SST) Part II:GHRSST-DV-Argo Obs. System", California Institute of Technology, Feb. 28, 2011, 19 pages.

NASA,"Utilizing Ocean Thermal Energy in a Submarine Robot", NASA's Jet Propulsion Laboratory, NASA Tech Briefs NPO-43304, Dec. 18, 2008, 4 pages.

T. Shimura et al., "Long-Range Time Reversal Communication in Deep Water: Experimental Results", J. Acoust. Soc. Am. 132 (1), Jul. 2012, [http://dx.doi.org/10.1121/1.4730038], Jun. 19, 2012, 5 pages.

Mosca, et al.; "Low-Frequency Acoustic Source for AUV Long-Range Communication"; iXSea, France; JAMSTEC, Japan, Jul. 2013, 9 pages.

Gregory W. Heinen, "Modified CO2 Cycle for Long Endurance Unmanned Underwater Vehicles and Resultant Chirp Acoustic Capability", U.S. Appl. No. 15/091,415, filed Apr. 5, 2016.

Gregory W. Heinen et al., "Apparatus and Method for Periodically Charging Ocean Vessel or Other System Using Thermal Energy Conversion", U.S. Appl. No. 15/173,178, filed Jun. 3, 2016.

Gregory W. Heinen, et al., "Systems and Methods Supporting Periodic Exchange of Power Supplies in Uderwater Vehicles or Other Devices," U.S. Appl. No. 15/264,399, filed Sep. 13, 2016.

Bowen, M.F., "A Passive Capture Latch for Odyssey-Class AUVs," Technical Report WHOI-98-12, Jun. 12, 1998, 91 pages, publisher Woods Hole Oceanographic Institution, Woods Hole, MA.

Singh, Hanumant, et al., "Docketing for an Autonomous Ocean Sampling Network," IEEE Journal of Oceanic Engineering, Oct. 2001, pp. 498-514, vol. 26, No. 4, publisher IEEE, Piscataway, New Jersey.

Bowen, Andrew D., et al., "The Nereus Hybrid Underwater Robotic Vehicle for Global Ocean Science Operations to 11,000m Depth," 2008, 10 pages, publisher IEEE, Piscataway, New Jersey.

Hardy, Tim, et al., "Unmanned Underwater Vehicle (UUV) deployment and retrieval considerations for submarines," Paper on UUV Development and Retrieval Options for Submarines, Apr. 2008, pp. 1-15, publisher BMT Defense Services Ltd., Bath, United Kingdom.

Cowen, Steve, "Flying Plug: A Small UUV Designed for Submarine Data Connectivity (U)," Abstract, 1997, 21 pages, publisher PN.

Gish, Lynn Andrew, "Design of an AUV Recharging System," 2004, 134 pages, publisher Massachusetts Institute of Technology, Cambridge, Massachusetts.

Vandenberg, Troy D., "Manning and Maintainability of a Submarine Unmanned Undersea Vehicle (UUV) Program: A Systems Engineering Case Study," Thesis, Sep. 2010, 137 pages, publisher Naval Postgraduate School, Monterey, California.

Griffiths, Gwyn, "Technology and Applications of Autonomous Underwater Vehicles," 2003, pp. 93-108, publisher Taylor & Franscis, New York, NY.

Galletti Di Cadilhac, Robin, "Docketing System," 2003, pp. 93-108, publisher Taylor & Franscis, New York, NY.

Singh, Hanumant, et al., "AOSN MURI: Docketing for an Autonomous Ocean Sampling Network," Program #: ONR-322 OM/AOSN N00014-95-1-13166, 1998, 6 pages, available at http://www.whoi.edu/DSL/hanu/.

Foreign Communication from Related Counterpart Application, PCT Application No. PCT/US2016/062518, International Search Report and the Written Opinion of the International Searching Authority dated May 18, 2017, 12 pages.

Notification of Transmittal of the International Search Report and the Written Opinion of the International Searching Authority, or the Declaration dated May 29, 2017 in connection with International Patent Application No. PCT/US2017/017499.

* cited by examiner

HYDRAULIC DRIVES FOR USE IN CHARGING SYSTEMS, BALLAST SYSTEMS, OR OTHER SYSTEMS OF UNDERWATER VEHICLES

TECHNICAL FIELD

This disclosure generally relates to underwater vehicles. More specifically, this disclosure relates to hydraulic drives for use in charging systems, ballast systems, or other systems of underwater vehicles.

BACKGROUND

Unmanned underwater vehicles (UUVs) can be used in a number of applications, such as undersea surveying, recovery, or surveillance operations. However, supplying adequate power to UUVs for prolonged operation can be problematic. For example, one prior approach simply tethers a UUV to a central power plant and supplies power to the UUV through the tether. However, this clearly limits the UUV's range and deployment, and it can prevent the UUV from being used in situations requiring independent or autonomous operation. Another prior approach uses expanding wax based on absorbed heat to generate power, but this approach provides power in very small amounts, typically limited to less than about 200 Watts (W) at a 2.2 Watt-hour (WHr) capacity. Yet another prior approach involves using fuel cells in a UUV to generate power, but fuel cells typically require large packages and substantial space. It is also often necessary or desirable to provide ballast systems on UUVs in order to help stabilize the UUVs and provide buoyance management during use.

SUMMARY

This disclosure provides hydraulic drives for use in charging systems, ballast systems, or other systems of underwater vehicles.

In a first embodiment, an apparatus includes first and second tanks each configured to receive and store a refrigerant under pressure. The apparatus also includes at least one generator configured to receive flows of the refrigerant between the tanks and to generate electrical power based on the flows of the refrigerant. The apparatus further includes first and second hydraulic drives associated with the first and second tanks, respectively. Each hydraulic drive includes a first piston within the associated tank, a channel fluidly coupled to the associated tank and configured to contain hydraulic fluid, and a second piston within the channel and configured to move within the channel in order to vary an amount of the hydraulic fluid within the associated tank and vary a position of the first piston within the associated tank. The channel of each hydraulic drive has a cross-sectional area that is less than a cross-sectional area of the associated tank.

In a second embodiment, a system includes an underwater vehicle having a body, fins projecting from the body, and a power generator. The power generator includes first and second tanks each configured to receive and store a refrigerant under pressure. The power generator also includes at least one generator configured to receive flows of the refrigerant between the tanks and to generate electrical power based on the flows of the refrigerant. The power generator further includes first and second hydraulic drives associated with the first and second tanks, respectively. Each hydraulic drive includes a first piston within the associated tank, a channel fluidly coupled to the associated tank and configured to contain hydraulic fluid, and a second piston within the channel and configured to move within the channel in order to vary an amount of the hydraulic fluid within the associated tank and vary a position of the first piston within the associated tank. The channel of each hydraulic drive has a cross-sectional area that is less than a cross-sectional area of the associated tank.

In a third embodiment, an apparatus includes a cavity configured to receive a material and a hydraulic drive. The hydraulic drive includes a first piston within the cavity, a channel fluidly coupled to the cavity and configured to contain hydraulic fluid, and a second piston within the channel and configured to move within the channel in order to vary an amount of the hydraulic fluid within the cavity, vary a position of the first piston within the cavity, and vary an amount of the material within the cavity. The channel of the hydraulic drive has a cross-sectional area that is less than a cross-sectional area of the cavity.

Other technical features may be readily apparent to one skilled in the art from the following figures, descriptions, and claims.

BRIEF DESCRIPTION OF THE DRAWINGS

For a more complete understanding of this disclosure, reference is made to the following description, taken in conjunction with the accompanying drawings, in which.

DETAILED DESCRIPTION

FIGS. 1 through 8, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

FIGS. 1A through 1D illustrate a first example underwater vehicle 100 having one or more hydraulic drives in accordance with this disclosure. In this example, the vehicle 100 denotes an unmanned underwater vehicle or other device that can function as both a buoy and a glider within an ocean or other body of water. The vehicle 100 could be used to support various functions, such as undersea surveying, recovery, or surveillance operations.

Figure 1A:
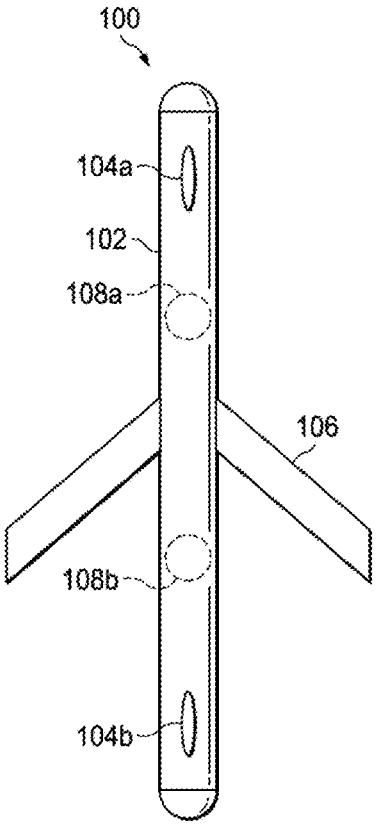
FIGS. 1A through 1D illustrate a first example underwater vehicle having one or more hydraulic drives in accordance with this disclosure.
Figure 1B:
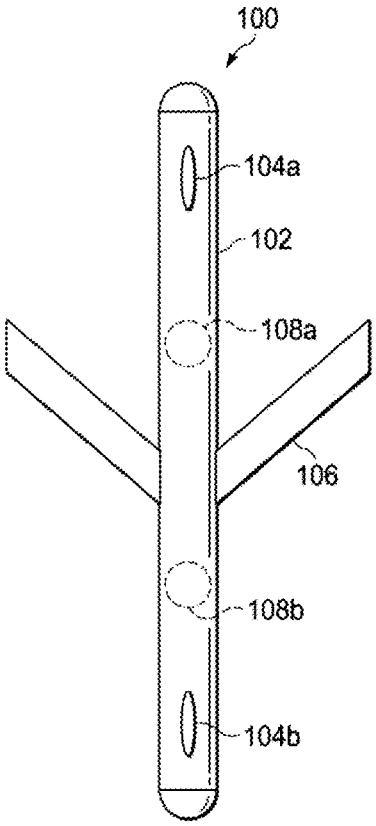

As shown in FIGS. 1A and 1B, the vehicle 100 includes a body 102 having fins 104*a*-104*b* and wings 106. The body 102 denotes any suitable structure configured to encase, protect, or otherwise contain other components of the vehicle 100. The body 102 could be formed from any suitable material(s) and in any suitable manner. The body 102 can be formed so that the vehicle 100 is able to withstand extremely elevated pressures found at deep depths in an ocean or other body of water. In some embodiments, the body 102 could allow the vehicle 100 to operate at depths of up to 1,000 meters or more.

The fins 104*a*-104*b* denote projections from the body 102 that help to stabilize the body 102 during travel. Each of the fins 104*a*-104*b* could be formed from any suitable material(s) and in any suitable manner. Also, each of the fins 104*a*-104*b* could have any suitable size, shape, and dimensions. Further, at least some of the fins 104*a*-104*b* could be movable or adjustable to help alter the course of the body 102 and to steer the body 102 through water during travel. In addition, the numbers and positions of the fins 104*a*-104*b* shown here are examples only, and any numbers and positions of fins could be used to support desired operations of the vehicle 100.

As described below, the underwater vehicle 100 can both ascend and descend within a body of water during use. In some embodiments, the fins 104*a* could be used to steer the vehicle 100 while ascending, and the fins 104*b* could be used to steer the vehicle 100 while descending. Moreover, when the vehicle 100 is ascending, the fins 104*a* can be used to control the pitch of the vehicle 100, and a differential between the fins 104*a* can be used to control the roll of the vehicle 100. Similarly, when the vehicle 100 is descending, the fins 104*b* can be used to control the pitch of the vehicle 100, and a differential between the fins 104*b* can be used to control the roll of the vehicle 100.

The wings 106 support gliding movement of the vehicle 100 underwater. The wings 106 are moveable to support different directions of travel. For example, the wings 106 are swept downward in FIG. 1A when the vehicle 100 is ascending, and the wings 106 are swept upward in FIG. 1B when the vehicle 100 is descending. In this way, the wings 106 help to facilitate easier or more rapid movement of the vehicle 100 while ascending or descending. Each of the wings 106 could be formed from any suitable material(s) and in any suitable manner. Also, each of the wings 106 could have any suitable size, shape, and dimensions. In addition, the number and positions of the wings 106 shown here are examples only, and any number and positions of wings could be used to support desired operations of the vehicle 100.

The underwater vehicle 100 may further include one or more ballasts 108*a*-108*b*, which help to control the center of gravity of the vehicle 100. As described in more detail below, material can move within a power supply or other portion of the vehicle 100, and that movement can alter the center of gravity of the vehicle 100. Underwater gliders can be particularly susceptible to changes in their centers of gravity, so the vehicle 100 can adjust one or more of the ballasts 108*a*-108*b* as needed or desired (such as during ascent or descent) to maintain the center of gravity of the vehicle 100 substantially at a desired location. In some embodiments, the ballasts 108*a*-108*b* are located on opposite sides of the vehicle's power supply along a length of the vehicle 100. Each ballast 108*a*-108*b* includes any suitable structure configured to modify the center of gravity of an underwater vehicle. Note that the number and positions of the ballasts 108*a*-108*b* shown here are examples only, and any number and positions of ballasts could be used in the vehicle 100.

Figure 1C:
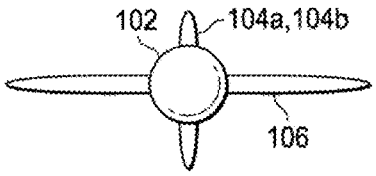
Figure 1D:
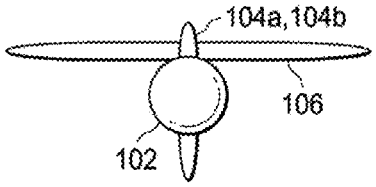

FIGS. 1C and 1D illustrate different possible end views of the underwater vehicle 100. In FIG. 1C, the wings 106 are positioned and extend from the body 102 along a line through a center of the body 102. In FIG. 1D, the wings 106 are positioned and extend from the body 102 along a line tangential to the body 102. In either case, the wings 106 can be stowed in a folded position where the wings 106 extend along the length of the body 102 and later unfolded before, during, or after deployment.

Figure 2A:
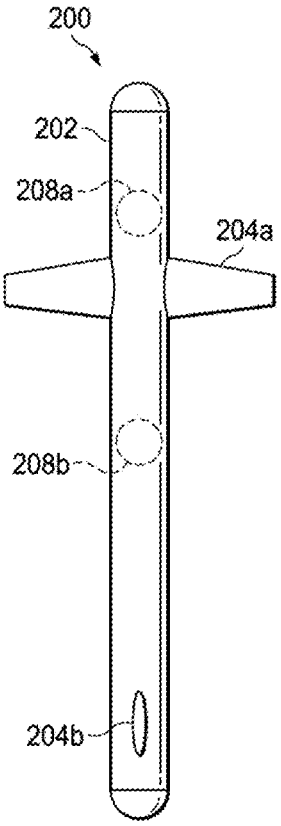
FIGS. 2A through 2C illustrate a second example underwater vehicle having one or more hydraulic drives in accordance with this disclosure.
Figure 2B:
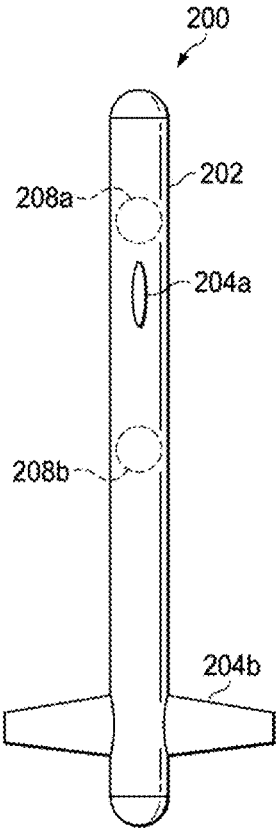
Figure 2C:
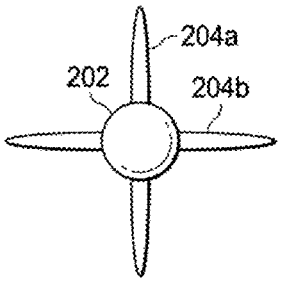

FIGS. 2A through 2C illustrate a second example underwater vehicle 200 having one or more hydraulic drives in accordance with this disclosure. In this example, the vehicle 200 denotes an unmanned underwater vehicle or other device that can function as a buoy within an ocean or other body of water. The vehicle 200 could be used to support various functions, such as undersea surveying, recovery, or surveillance operations.

As shown in FIGS. 2A through 2C, the underwater vehicle 200 includes a body 202 and fins 204*a*-204*b*. The body 202 denotes any suitable structure configured to encase, protect, or otherwise contain other components of the vehicle 200. The body 202 could be formed from any suitable material(s) and in any suitable manner. The fins 204*a*-204*b* denote projections from the body 202 that help to stabilize the body 202 during travel. Each of the fins 204*a*-204*b* could be formed from any suitable material(s) and in any suitable manner. Also, each of the fins 204*a*-204*b* could have any suitable size, shape, and dimensions. Further, at least some of the fins 204*a*-204*b* could be movable or adjustable to help alter the course of the body 202 and to steer the body 102 through water during travel. In addition, the numbers and positions of the fins 204*a*-204*b* shown here are examples only, and any numbers and positions of fins could be used to support desired operations of the vehicle 200. The vehicle 200 may further include one or more ballasts 208*a*-208*b*, which help to control the center of gravity of the vehicle 200.

As can be seen in FIGS. 2A through 2C, the underwater vehicle 200 lacks wings used to support gliding of the vehicle 200 through water. As a result, the vehicle 200 denotes a device that can function as a buoy but generally not as a glider within an ocean or other body of water.

In some embodiments, each underwater vehicle 100 or 200 shown in FIGS. 1A through 2C could remain generally vertical during normal operation. In this configuration, the vehicle 100 or 200 is generally operating as a buoy and can collect information or perform other tasks. Of course, exact vertical orientation is not required during operation of the vehicle 100 or 200. During movement up and down within a body of water, the vehicle 100 or 200 can travel through the water to the surface or to a desired depth of the water. While submerged, the vehicle 100 or 200 could perform operations such as capturing various sensor measurements or searching for anomalies. Periodic surfacing of the vehicle 100 or 200 may allow the vehicle 100 or 200 to (among other things) transmit and receive data, verify its current location, and perform operations needed for power generation (note that the term "periodic" and its derivatives do not require action at a specific interval but merely that an action occurs repeatedly, possibly although not necessarily at a specific interval). After each surfacing, the vehicle 100 or 200 can re-submerge and, if needed, travel at an angle to a desired depth. The angle of travel may be based on the current location of the vehicle 100 or 200 and its desired location, which may allow the vehicle 100 or 200 to operate continuously or near-continuously at a desired station.

As described in more detail below, devices such as the vehicles 100 and 200 can include one or more systems that include one or more hydraulic drives. For example, each of the vehicles 100 and 200 could include a system that supports periodic charging of the vehicle, where hydraulic drives are used to push refrigerant from one tank to another through a turbine or other power generator. As another example, each of the ballasts 108*a*-108*b*, 208*a*-208*b* of the vehicles 100 and 200 could include a hydraulic drive to pull or push water into a cavity in order to alter the center of gravity of the vehicle.

Although FIGS. 1A through 2C illustrate examples of underwater vehicles 100 and 200 having one or more hydraulic drives, various changes may be made to FIGS. 1A through 2C. For example, these figures illustrate example underwater vehicles only, and the periodic charging systems, ballast systems, and hydraulic drives described in this patent document could be used in any other suitable device or system.

Figure 3:
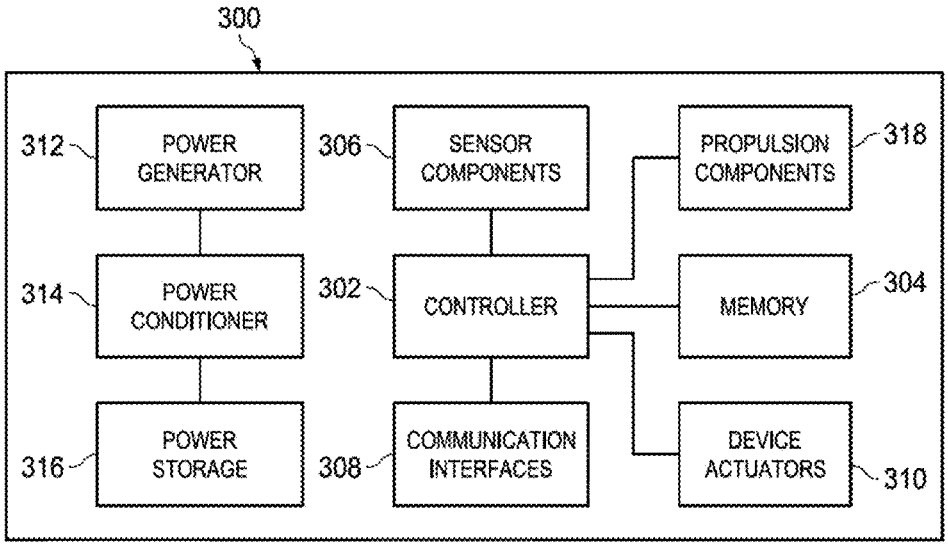
FIG. 3 illustrates example components of an underwater vehicle having one or more hydraulic drives in accordance with this disclosure.

FIG. 3 illustrates example components of an underwater vehicle 300 having one or more hydraulic drives in accordance with this disclosure. The underwater vehicle 300 could, for example, denote either of the underwater vehicles 100 and 200 described above. The components shown in FIG. 3 could therefore denote internal or other components within either of the vehicles 100 and 200 that were not shown in FIGS. 1A through 2C.

As shown in FIG. 3, the vehicle 300 includes at least one controller 302 and at least one memory 304. The controller 302 controls the overall operation of the vehicle 300 and can denote any suitable hardware or combination of hardware and software/firmware for controlling the vehicle 300. For example, the controller 302 could denote at least one processor configured to execute instructions obtained from the memory 304. The controller 302 may include any suitable number(s) and type(s) of processors or other computing or control devices in any suitable arrangement. Example types of controllers 302 include microprocessors, microcontrollers, digital signal processors, field programmable gate arrays, application specific integrated circuits, and discrete circuitry.

The memory 304 stores data used, generated, or collected by the controller 302 or other components of the vehicle 300. Each memory 304 represents any suitable structure(s) configured to store and facilitate retrieval of information (such as data, program code, and/or other suitable information on a temporary or permanent basis). Some examples of the memory 304 can include at least one random access memory, read only memory, Flash memory, or any other suitable volatile or non-volatile storage and retrieval device(s).

The vehicle 300 in this example also includes one or more sensor components 306, one or more communication interfaces 308, and one or more device actuators 310. The sensor components 306 include sensors that could be used to sense any suitable characteristics of the vehicle 300 itself or the environment around the vehicle 300. For example, the sensor components 306 could include a position sensor, such as a Global Positioning System (GPS) sensor, which can identify the position of the vehicle 300. This could be used, for instance, to help make sure that the vehicle 300 is following a desired path or is maintaining its position at or near a desired location. The sensor components 306 could also include audio sensors for capturing audio signals, photodetectors or other cameras for capturing video signals or photographs, or any other or additional components for capturing any other or additional information. Each sensor component 306 includes any suitable structure for sensing one or more characteristics.

The communication interfaces 308 support interactions between the vehicle 300 and other devices or systems. For example, the communication interfaces 308 could include at least one radio frequency (RF) or other transceiver configured to communicate with one or more satellites, airplanes, ships, or other nearby or distant devices. The communication interfaces 308 allow the vehicle 300 to transmit data to one or more external destinations, such as information associated with data collected by the sensor components 306. The communication interfaces 308 also allow the vehicle 300 to receive data from one or more external sources, such as instructions for other or additional operations to be performed by the vehicle 300 or instructions for controlling where the vehicle 300 operates. Each communication interface 308 includes any suitable structure(s) supporting communication with the vehicle 300.

The device actuators 310 are used to adjust one or more operational aspects of the vehicle 300. For example, the device actuators 310 could be used to move the fins 104*a*-104*b*, 204*a*-204*b* of the vehicle while the vehicle is ascending or descending. The device actuators 310 could also be used to control the positioning of the wings 106 to control whether the wings 106 are stowed or swept upward or downward (depending on the direction of travel). Each device actuator 310 includes any suitable structure for physically modifying one or more components of an underwater vehicle.

The vehicle 300 further includes a power generator 312, a power conditioner 314, and a power storage 316. The power generator 312 generally operates to create electrical energy based on movement of the vehicle 300. In particular, the power generator 312 can operate based on different water temperatures or water pressures that the vehicle 300 experiences over the course of its travel. The power generator 312 includes any suitable structure configured to generate electrical energy based on temperature or pressure.

The power conditioner 314 is configured to condition or convert the power generated by the power generator 312 into a suitable form for storage or use. For example, the power conditioner 314 could receive a direct current (DC) signal from the power generator 312, filter the DC signal, and store power in the power storage 316 based on the DC signal. The power conditioner 314 could also receive power from the power storage 316 and convert the power into suitable voltage(s) and current(s) for other components of the vehicle 300. The power conditioner 314 includes any suitable structure(s) for conditioning or converting electrical power.

The power storage 316 is used to store electrical power generated by the power generator 312 for later use. The power storage 316 denotes any suitable structure(s) for storing electrical power, such as one or more batteries or super-capacitors.

The vehicle 300 further includes one or more propulsion components 318, which denote components used to physically move the vehicle 300 through water. The propulsion components 318 could denote one or more motors or other propulsion systems. In some embodiments, the propulsion components 318 could be used only when the vehicle 300 is traveling between a position at or near the surface and a desired depth. During other time periods, the propulsion components 318 could be deactivated. Of course, other embodiments could allow the propulsion components 318 to be used at other times, such as to help maintain the vehicle 300 at a desired location or to help move the propulsion components 318 to avoid observation or detection.

The power generated by the power generator 312 and the power stored in the power storage 316 can be supplied to any of the components in FIG. 3. For example, electrical power could be provided to the controller 302 and memory 304 to facilitate computations and instruction execution by the controller 302 and data storage/retrieval by the memory 304. Electrical power could also be provided to the sensor components 306, communication interfaces 308, and device actuators 310 in order to support sensing, communication, and actuation operations. In addition, electrical power could be provided to the propulsion components 318 in order to support movement of the vehicle 300.

As described in more detail below, the power generator 312 could include one or more hydraulic drives that operate based on elevated water pressures (and possibly temperature differentials) to force refrigerant through a turbine or other generator. Also or alternatively, one or more of the ballasts 108*a*-108*b*, 208*a*-208*b* could include one or more hydraulic drives.

Although FIG. 3 illustrates one example of components of an underwater vehicle 300 having one or more hydraulic drives, various changes may be made to FIG. 3. For example, various components in FIG. 3 could be combined, further subdivided, rearranged, or omitted or additional components could be added according to particular needs.

Figure 4:
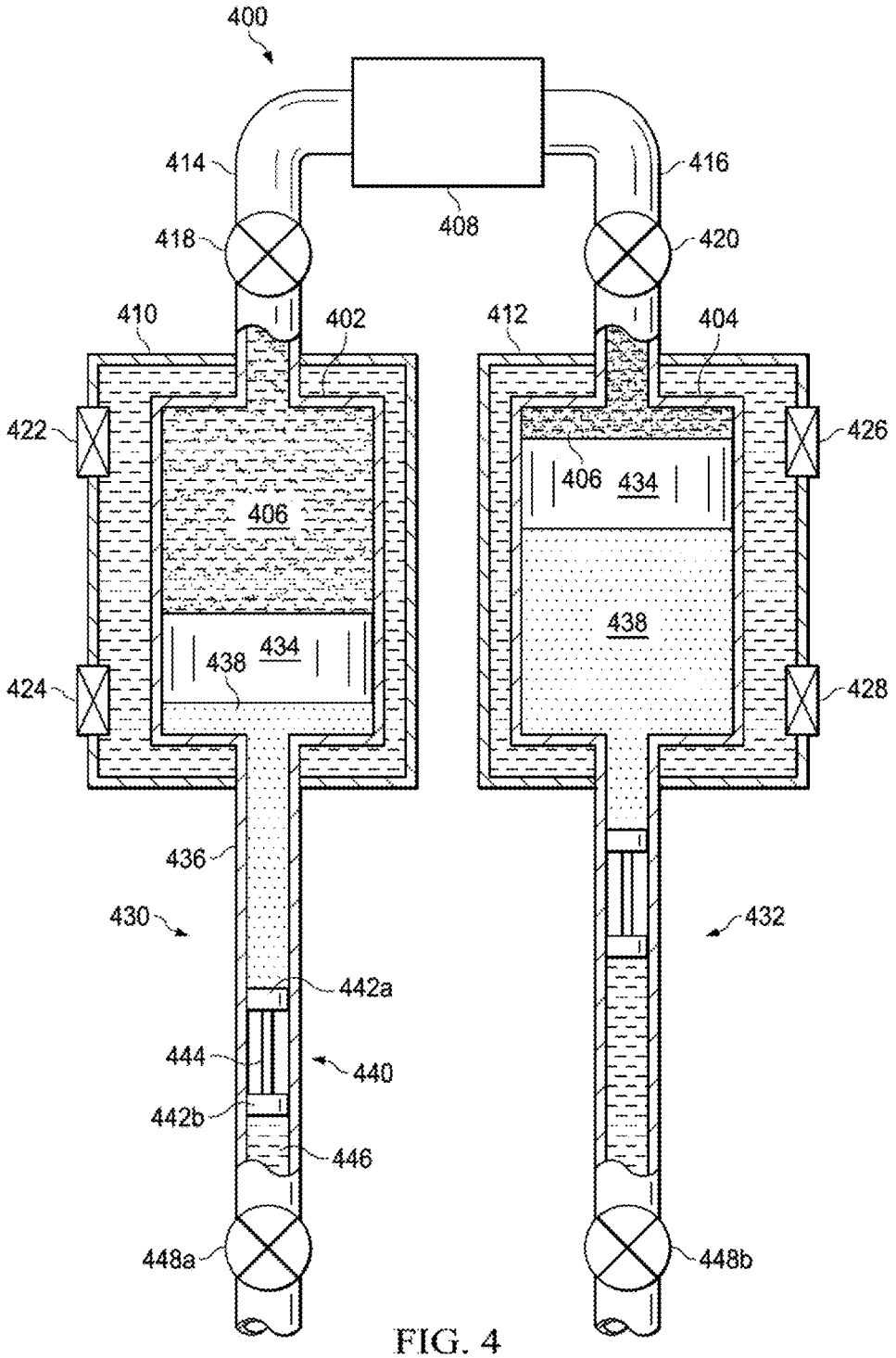
FIGS. 4 through 5G illustrate an example charging system for periodically charging an underwater vehicle in accordance with this disclosure.
Figure 5A:
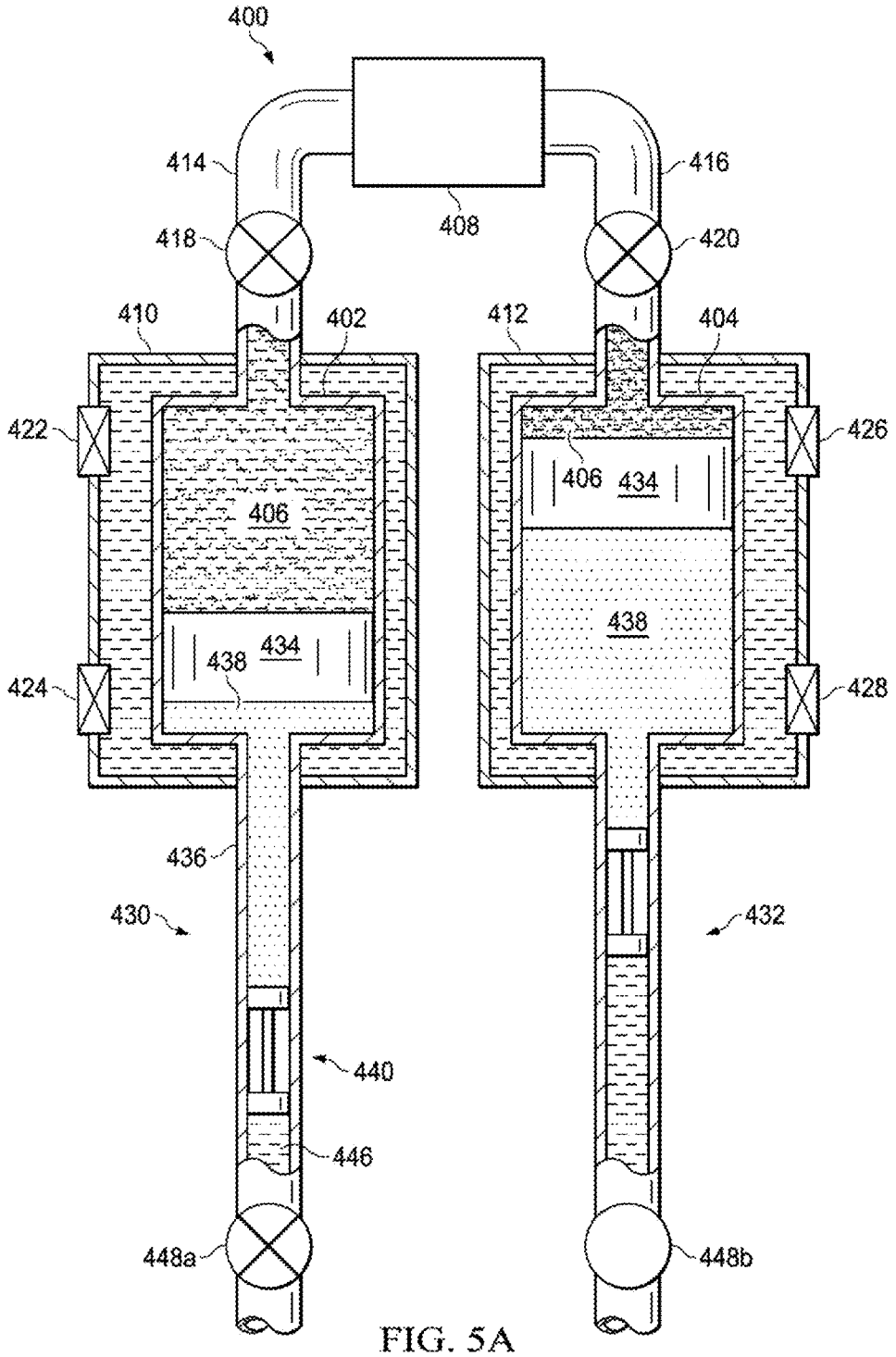
Figure 5B:
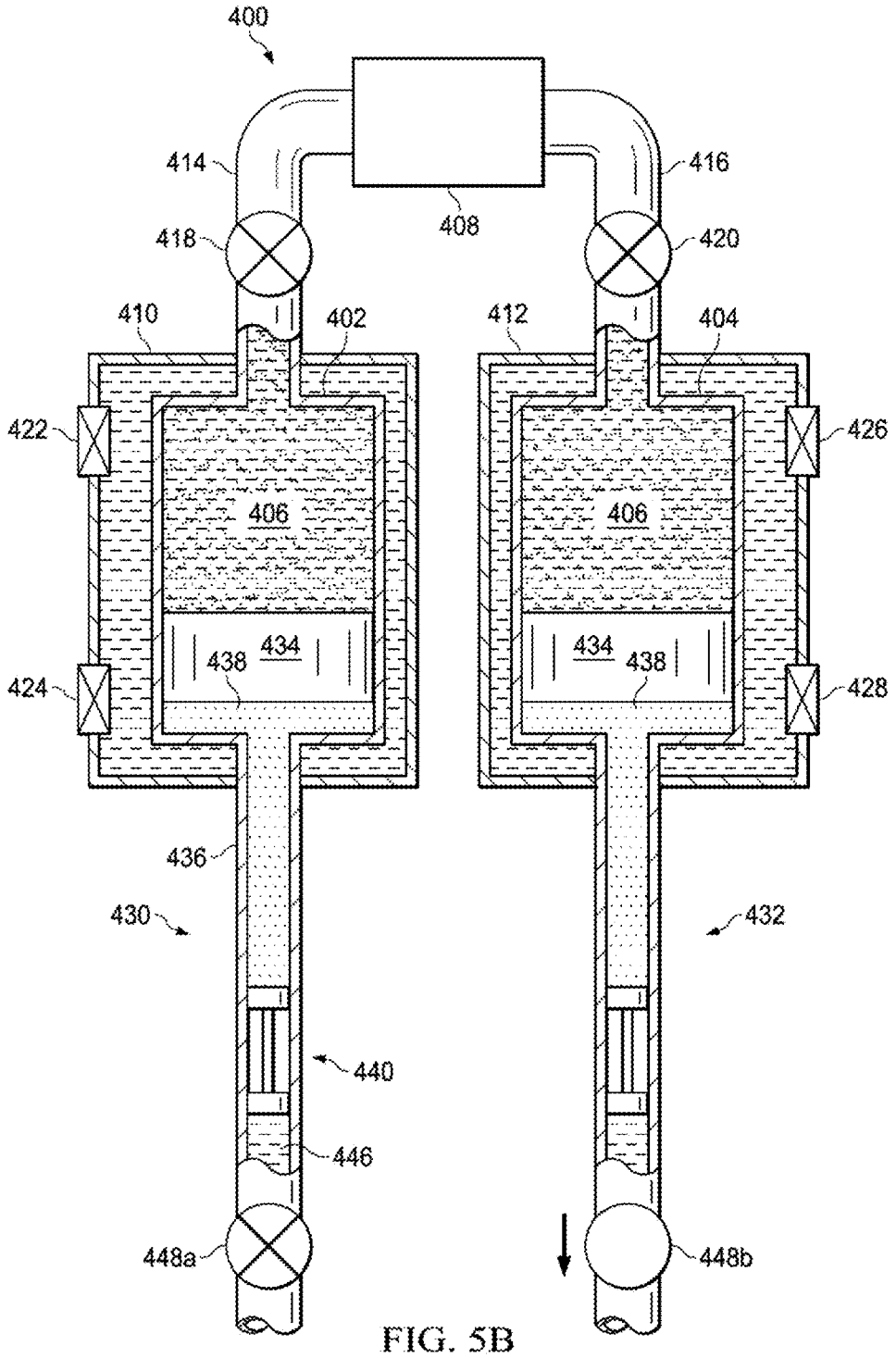
Figure 5C:
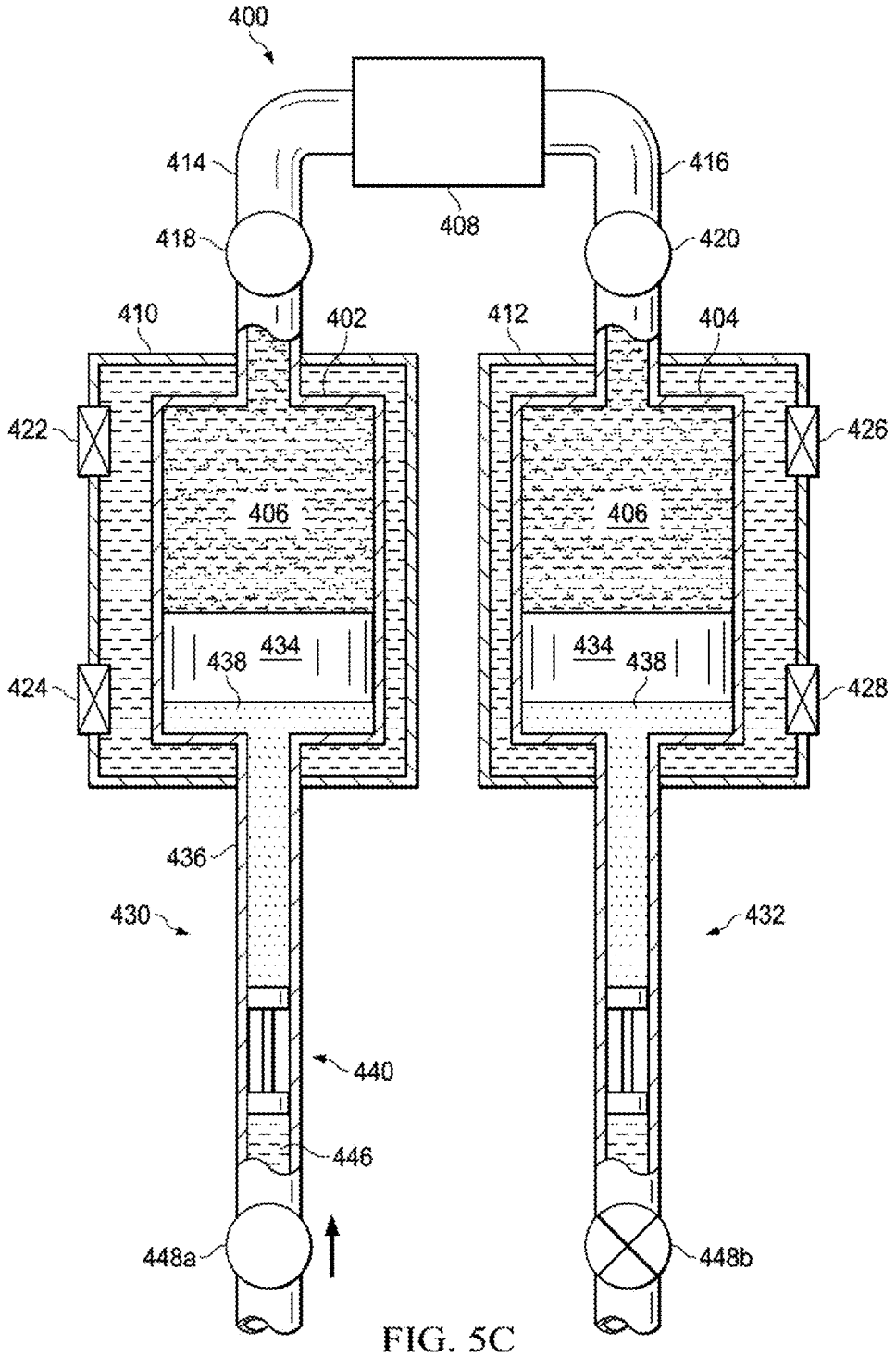
Figure 5D:
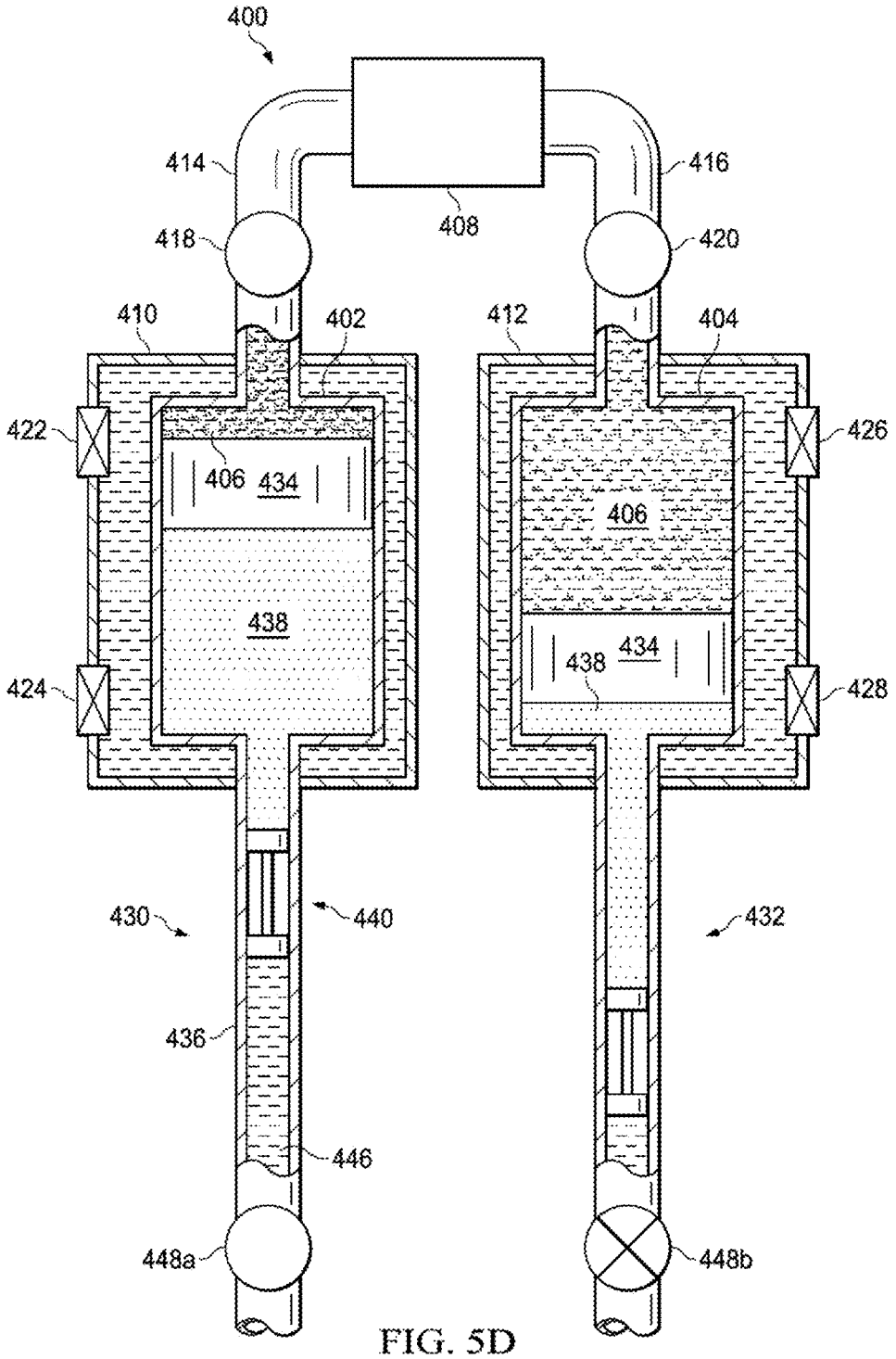
Figure 5E:
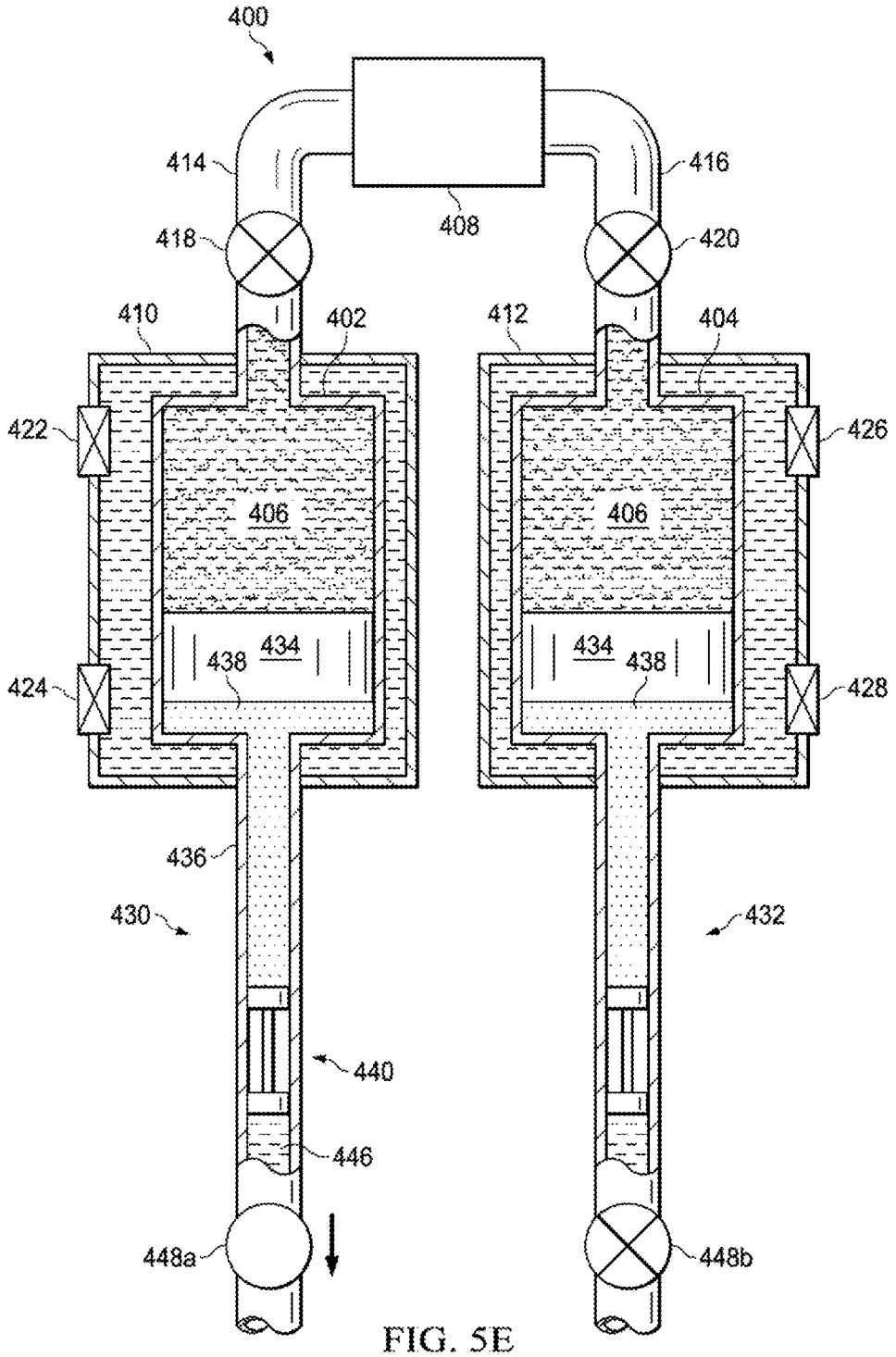
Figure 5F:
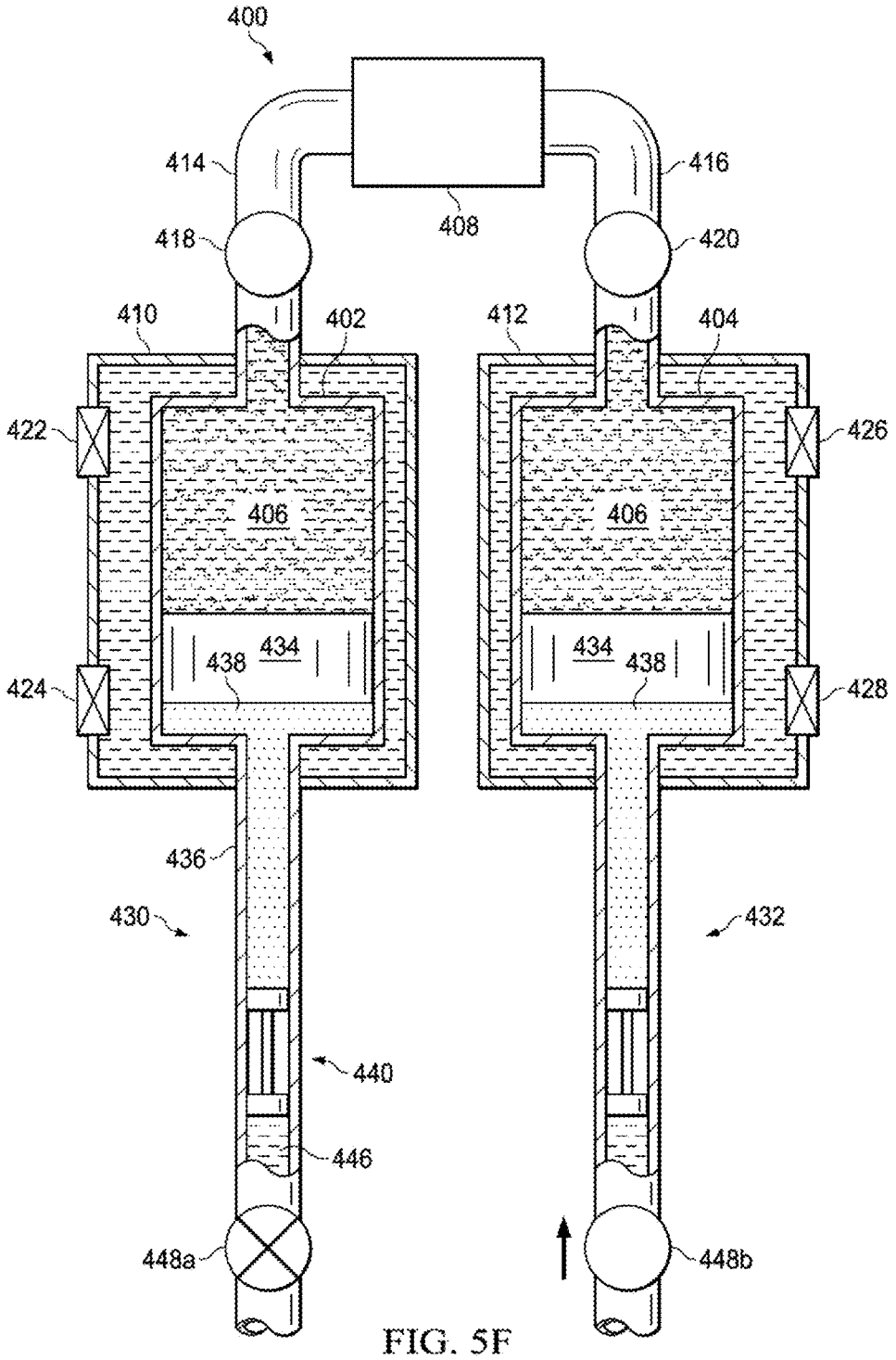
Figure 5G:
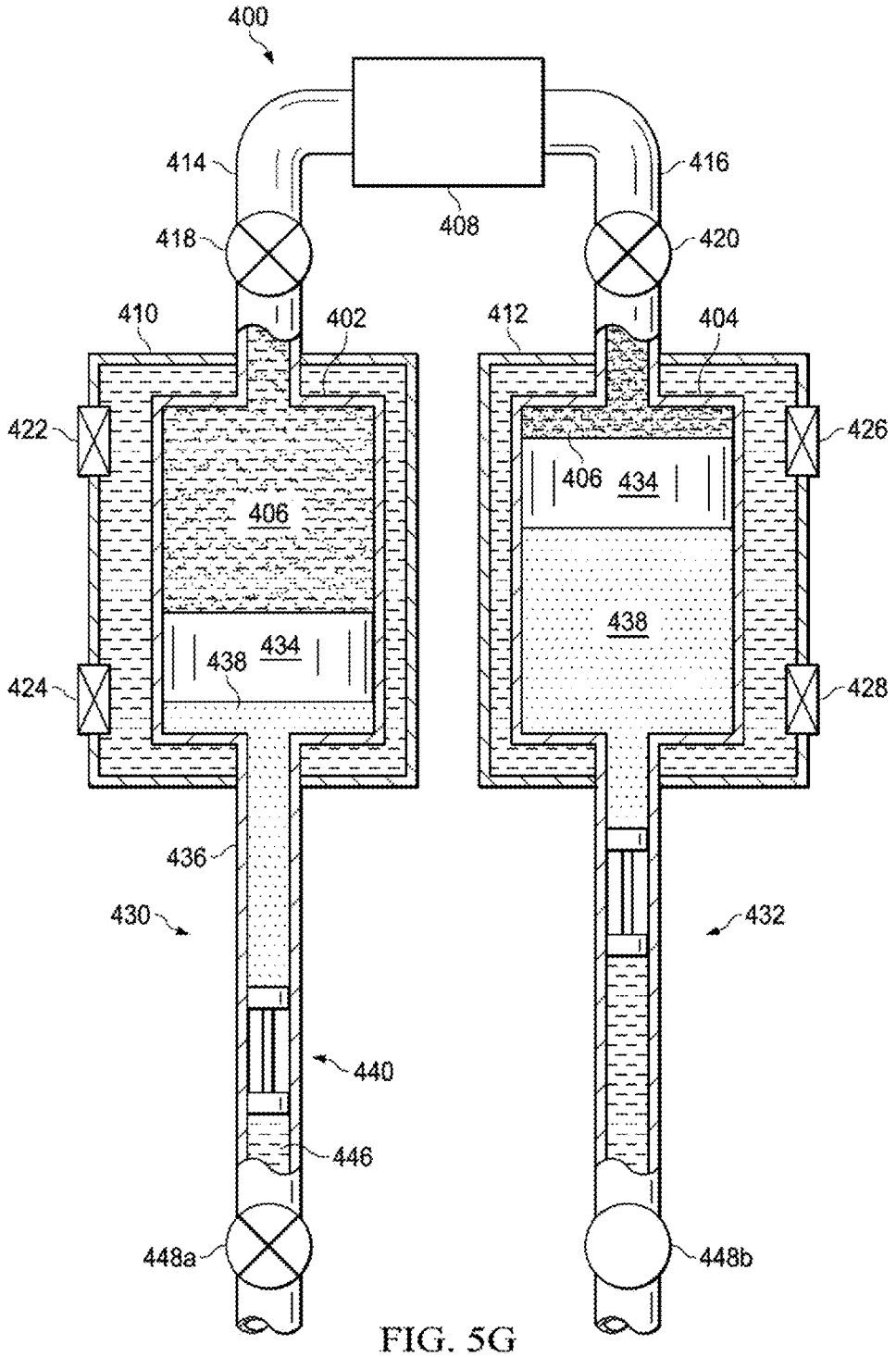

FIGS. 4 through 5G illustrate an example charging system for periodically charging an underwater vehicle in accordance with this disclosure. In particular, FIG. 4 illustrates an example charging system 400, and FIGS. 5A through 5G illustrate example operations of the charging system 400. This type of charging system could, for example, be implemented as the power generator 312 in the vehicle 300 of FIG. 3, although this type of charging system could be used in any other suitable device or system.

As shown in FIG. 4, the charging system 400 generally employs a Carnot-Brayton cycle involving two tanks 402 and 404. A refrigerant 406 is transferred back and forth between the tanks 402 and 404 through a generator 408. Each tank 402 or 404 is configured to hold the refrigerant 406 under pressure and to provide the refrigerant 406 through the generator 408 to the other tank 404 or 402. When the refrigerant 406 passes through the generator 408, the generator 408 generates electrical power.

Each tank 402 and 404 includes any suitable structure configured to hold a refrigerant under pressure. The refrigerant 406 includes any suitable fluid used to transfer heat between the tanks 402 and 404, such as gaseous or liquid carbon dioxide. The generator 408 includes any suitable structure for generating electrical energy based on a flow of refrigerant, such as a Pelton turbine or a brushless DC (BLDC) generator. In particular embodiments, the generator 408 could include a vane motor, impulse, or axial flow turbine and a choked flow orifice. If implemented in this manner, different turbines could be used to generate power for refrigerant flows in different directions, with choked flow orifices on different sides of the different turbines. Alternatively, adjustable orifices could be used on opposing sides of a single turbine and opened or closed based on the direction of refrigerant flow.

The charging system 400 can also include multiple insulated water jackets 410 and 412. Each insulated water jacket 410 and 412 receives and retains warmer or colder water in order to facilitate movement of the refrigerant 406 between the tanks 402 and 404. For example, the tank 402 or 404 containing more refrigerant 406 can be surrounded by warmer water, increasing the pressure in that tank. Conversely, the tank 404 or 402 containing less refrigerant 406 can be surrounded by colder water, lowering the pressure in that tank. The pressure difference can be used to facilitate easier or more effective refrigerant transport between the tanks 402 and 404. Each insulated water jacket 410 and 412 includes any suitable insulated structure configured to receive and retain water. The insulated water jackets 410 and 412 need not be pressurized and can be unpressurized containers.

Conduits 414 and 416 respectively couple the tanks 402 and 404 to the generator 408. Each conduit 414 and 416 denotes any suitable passageway for a refrigerant. Each conduit 414 and 416 could be formed from any suitable material(s) and in any suitable manner. Note that while a single conduit 414 and 416 couples each tank 402 and 404 to the generator 408, multiple conduits could also be used for each tank. For example, different conduits could be used to support refrigerant flows in different directions (and possibly coupled to different generators 408).

Valves 418 and 420 are used to control the flow of the refrigerant 406 through the conduits 414 and 416. For example, the valve 418 controls whether the refrigerant 406 can enter or exit the tank 402 through the conduit 414, and the valve 420 controls whether the refrigerant 406 can enter or exit the tank 404 through the conduit 416. Each valve 418 and 420 denotes any suitable structure for controlling the flow of a refrigerant, such as a needle valve.

Additional valves 422-428 are included in the insulated water jackets 410 and 412 to control the flow of fresh water into and out of the insulated water jackets 410 and 412. For example, when the vehicle 300 is located at or near the surface of a body of water, the valves 422-424 or 426-428 could be opened so that fresh warmer water can be drawn into the insulated water jacket 410 or 412. When the vehicle 300 is located at a desired depth underwater, the valves 422-424 or 426-428 could be opened so that fresh colder water can be drawn into the insulated water jacket 410 or 412. Although not shown, pumps or other mechanisms can be used to help pull water into or push water out of the insulated water jackets 410 and 412. Also, although not shown, a water brake ram could be used to slow a vehicle's ascent or descent using water contained in the water jacket to be flushed. Each valve 422-428 denotes any suitable structure for controlling the flow of water into or out of an insulated water jacket.

The various valves 418-428 shown in FIG. 4 could be controlled in any suitable manner. For example, in some embodiments, the controller 302 of an underwater vehicle 300 could control the valves 418-428 as part of the overall control of the vehicle 300.

As shown in FIG. 4, each tank 402 and 404 is associated with a hydraulic drive 430 and 432, respectively. Each hydraulic drive 430 and 432 is configured to use water pressure when the vehicle 300 dives underwater to help force the refrigerant 406 out of one of the tanks 402 and 404. In this example, each hydraulic drive 430 or 432 includes a piston 434 within the associated tank 402 or 404. The piston 434 is sealed with sides of the associated tank so that all or substantially all of the refrigerant 406 cannot pass the piston 434. Each piston 434 denotes any suitable structure for moving within a tank and pushing a refrigerant.

Each hydraulic drive 430 or 432 also includes a channel 436 that contains a hydraulic fluid 438 and a movable piston structure 440. The channel 436 is fluidly coupled to the associated tank 402 or 404 so that the hydraulic fluid 438 can move freely into and out of the tank. The amount of hydraulic fluid 438 forced into the associated tank 402 or 404 controls the position of the piston 434 in that tank, thereby controlling the amount of force being applied to the refrigerant 406 in that tank. The channel 436 denotes any suitable passageway configured to hold a hydraulic fluid. The hydraulic fluid 438 denotes any suitable material that can be used to apply force against a piston, such as an oil.

The movable piston structure 440 represents a structure that moves based on external pressure in order to increase or decrease the amount of hydraulic fluid 438 within the associated tank 402 or 404. In this example, the movable piston structure 440 includes two small pistons 442*a*-442*b* attached by a connecting bar 444, which helps to provide two seals between the hydraulic fluid 438 and an external environment. An interior space between the pistons 442*a*-442*b* could contain air or fluid, such as castor oil. However, any other suitable piston(s) could be used as the piston structure 440. Although not shown, one or more stops could be used to control the range of possible motion of the movable piston structure 440.

The piston structure 440 is moved using water 446, which is allowed to enter the hydraulic drive 430 or 432 via a respective valve 448*a* or 448*b*. The water 446 can enter a channel 436 when the associated valve 448*a* or 448*b* is opened and the vehicle 300 is underwater at a suitable depth. The elevated water pressure can force the water 446 into the channel 436, pushing the associated piston structure 440 towards the associated tank 402 or 404 and pushing more of the hydraulic fluid 438 into the associated tank 402 or 404. In contrast, the water 446 can exit a channel 436 when the associated valve 448*a* or 448*b* is opened and the vehicle 300 is at or near the surface of a water body. The decreased water pressure and warmer temperature can allow gas within the associated tank 402 or 404 to expand and force some of the hydraulic fluid 438 out of the associated tank 402 or 404, pushing the associated piston structure 440 away from the associated tank 402 or 404 and forcing some of the water 446 out of the channel 436. Each valve 448*a*-448*b* denotes any suitable structure for controlling the flow of water into and out of a channel.

Example operations of the charging system 400 are shown in FIGS. 5A through 5G. As shown in FIG. 5A, the charging system 400 has just completed a prior power generation cycle. Most or all of the refrigerant 406 is located in the tank 402, and the valves 418 and 420 have been closed to prevent further transfer of refrigerant 406. The valve 448*a* is closed and the valve 448*b* is opened, so there is more water 446 in the hydraulic drive 432 than in the hydraulic drive 430.

As shown in FIG. 5B, the vehicle 300 has ascended, and the valve 448*b* remains opened. The water in the water jackets 410 and 412 can be flushed and replaced with warmer water. The higher ambient temperature and/or the higher temperature of the warmer water in the water jacket 412 can heat the refrigerant 406 in the tank 404, causing the refrigerant 406 to expand and push some of the water 446 out of the hydraulic drive 432 through the valve 448*b*. In some embodiments, the pistons 434 in the hydraulic drives 430 and 432 could be located at substantially the same positions within the tanks 402 and 404 at this point.

The vehicle 300 can then close the valve 448*b* and dive to a desired depth, such as several hundred meters or more. Once at a desired depth, the water in the water jacket 412 can be flushed and replaced with colder water. Also, the valves 418, 420, and 448*a* can be opened as shown in FIG. 5C. The temperature differential between the tanks 402 and 404 (created in part by the temperature differential of the water in the water jackets 410 and 412) and the pressure created by the piston 434 in the tank 402 (caused by water pressure through the valve 448*a*) causes most or all of the refrigerant 406 to flow from the tank 402 into the tank 404 through the generator 408, producing electrical power. Eventually, the charging system 400 reaches the state that is shown in FIG. 5D, where the bulk of the refrigerant 406 has been transferred to the tank 404 and the piston 434 in the tank 402 has reached its maximum travel.

As this point, the same process can occur with the tanks reversed. As shown in FIG. 5E, the vehicle 300 has ascended, and the valve 448*a* remains opened. The water in the water jackets 410 and 412 can be flushed and replaced with warmer water. The higher ambient temperature and/or the higher temperature of the warmer water in the water jacket 410 can heat the refrigerant 406 in the tank 402, causing the refrigerant 406 to expand and push some of the water 446 out of the hydraulic drive 430 through the valve 448*a*. In some embodiments, the pistons 434 in the hydraulic drives 430 and 432 could be located at substantially the same positions within the tanks 402 and 404 at this point.

The vehicle 300 can then close the valve 448*a* and dive to a desired depth, such as several hundred meters or more. Once at a desired depth, the water in the water jacket 410 can be flushed and replaced with colder water. Also, the valves 418, 420, and 448*b* can be opened as shown in FIG. 5F. The temperature differential between the tanks 402 and 404 (created in part by the temperature differential of the water in the water jackets 410 and 412) and the pressure created by the piston 434 in the tank 404 (caused by water pressure through the valve 448*b*) causes most or all of the refrigerant 406 to flow from the tank 404 into the tank 402 through the generator 408, producing electrical power. Eventually, the charging system 400 reaches the state that is shown in FIG. 5G, where the bulk of the refrigerant 406 has been transferred to the tank 402 and the piston 434 in the tank 404 has reached its maximum travel. This is the same condition shown in FIG. 5A.

The amount of power generated during these cycles can vary based on a number of factors, such as the size of the tanks 402 and 404, the amount of refrigerant 406 in the tanks 402 and 404, the temperatures of the tanks 402 and 404, and the amount of pressure applied by the pistons 434 in the tanks 402 and 404. In some embodiments, the charging system 400 could use about twenty pounds of carbon dioxide, the warmer water temperature could be about 25° C., the colder water temperature could be about 5° C., and a pressure differential of up to 500 pounds per square inch (PSI) or more could be created between the tanks 402 and 404 at a depth of 1,000 meters. Given these parameters, the charging system 400 could generate about 430 kJ of energy per dive.

Conventional "extended endurance" underwater vehicles are often limited by their total energy carrying capacity or their recharge resources. Charging systems based solely on thermal energy conversion can be limited by thermal absorption rates and convective limitations of heat transfer. In situ properties of ocean travel also include pressures at depth and convective flows from depth changes. The charging system 400 therefore combines the various properties of ocean thermal energy transfer into a single energy cycle in a closed-loop system. This enables underwater vehicles possessing this cycle to cross large distances or produce large quantities of electrical power without external resources or replenishment.

As noted above, the charging system 400 generally employs a Carnot-Brayton cycle. The Carnot portion of the cycle uses the hydraulic pistons 434 driven by pressure at depth. Pressure at depth increases the forces applied to the refrigerant 406 by the pistons 434 in the tanks 402 and 404, which occurs alternatively between the tanks 402 and 404. The Brayton portion of the cycle involves the use of high-pressure gas expanding through a turbine, where heat is added to the gas through evaporative cooling, the gas is passed through a generator, and the gas is then cooled.

The charging system 400 therefore provides power generation based on variable and fixed volumes. The use of the hydraulic drives 430 and 432 helps to provide the charging system 400 with a mechanical advantage to help pressurize the refrigerant 406 while overcoming resistance of the receiving vessel. As a result, the charging system 400 supports a variable volume power system that multiplies water pressures via a hydraulic mechanical advantage. For instance, an advantage of 3:1 allows 400 PSI of water pressure to be converted to 1,200 PSI of pressure by a piston 434 against the refrigerant 406, while an advantage of 4:1 allows 400 PSI of water pressure to be converted to 1,600 PSI of pressure by a piston 434 against the refrigerant 406. The mechanical advantage defined by the ratio X:1 indicates that a tank 402 or 404 is X times wider than the channel 436 of the associated hydraulic drive 430 or 432 or that the tank 402 or 404 has a cross-sectional area X times wider than a cross-sectional area of the channel 436 of the associated hydraulic drive 430 or 432 (where X is any whole or real number greater than one). This type of pressure can be suitable for use in gas transfer systems using carbon dioxide gas or other gaseous refrigerant 406. Moreover, hydraulic lines can route forces for better packaging of the charging system 400.

Although FIGS. 4 through 5G illustrate one example of a charging system 400 for periodically charging an underwater vehicle, various changes may be made to FIGS. 4 through 5G. For example, various components in each figure could be combined, further subdivided, rearranged, or omitted or additional components could be added according to particular needs. Also, shapes, sizes, and dimensions of various components in these figures could vary as needed or desired. In addition, the use of the water jackets 410 and 412 may be optional, such as when the water pressures applied to the hydraulic drives 430 and 432 generate refrigerant flows adequate for power generation.

Figure 6:
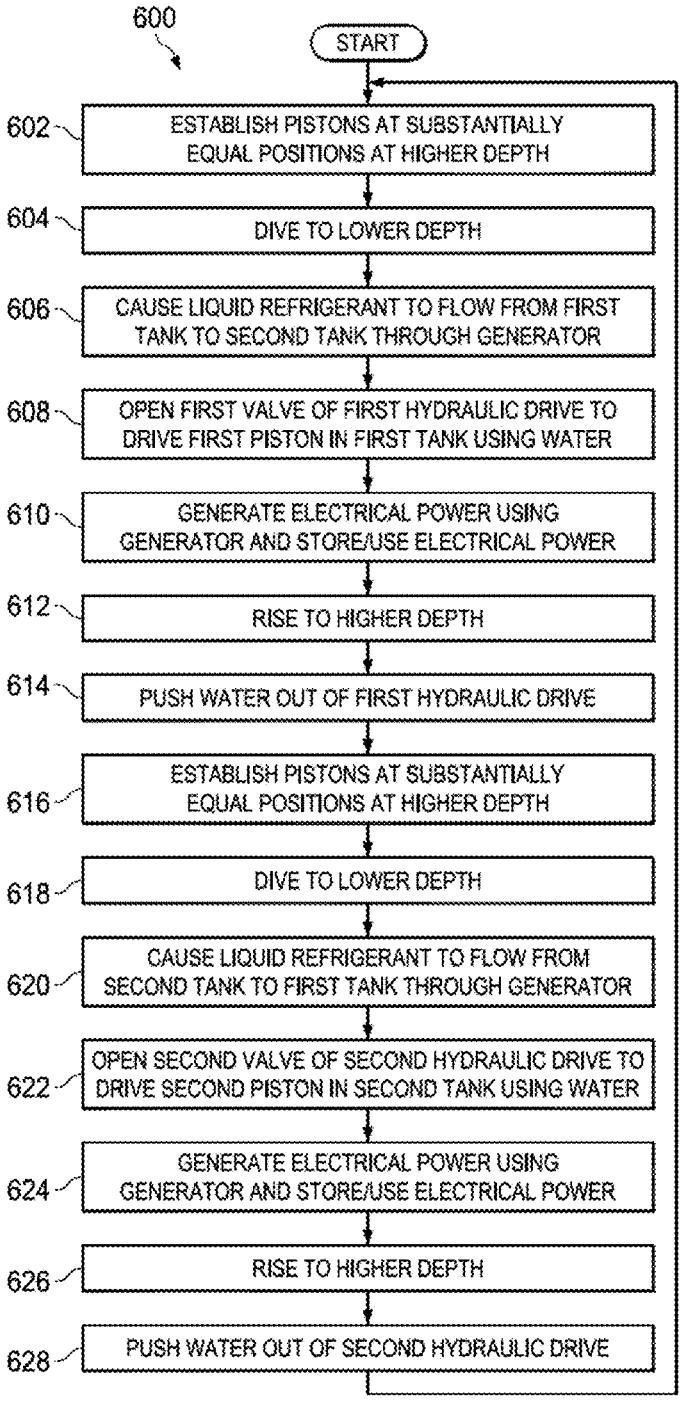
FIG. 6 illustrates an example method for periodically charging an underwater vehicle in accordance with this disclosure.

FIG. 6 illustrates an example method 600 for periodically charging an underwater vehicle in accordance with this disclosure. For ease of explanation, the method 600 is described with respect to the charging system 400 operating in the vehicle 300. However, the method 600 could be used in any other suitable device or system.

As shown in FIG. 6 and referring to components described in FIGS. 4 through 5G, pistons of the charging system are placed in substantially equal positions at a higher depth at step 602. This could include, for example, the charging system 400 pulling warmer water into the water jackets 410 and 412. This could also include the warmer water or a warmer ambient temperature heating the refrigerant 406 in the tank 404, causing the refrigerant 406 to expand and push at least some of the water 446 out of the hydraulic drive 432 through the valve 448*b*.

The underwater vehicle dives to a lower depth at step 604. This could include, for example, the charging system 400 closing the valve 448*b*. This could also include the controller 302 of the vehicle 300 controlling the propulsion components 318 so that the vehicle 300 dives to a desired depth, such as up to 1,000 meters or more. A refrigerant is caused to flow from a first tank through a generator and into a second tank at step 606. This could include, for example, the charging system 400 pulling colder water into the water jacket 412 and opening the valves 418 and 420. This could also include the refrigerant 406 flowing from the tank 402 to the tank 404. A first valve of a first hydraulic drive is opened to drive a first piston in the first tank using water at step 608. This could include, for example, the charging system 400 opening the valve 448*a* to allow water 446 to enter the hydraulic drive 430. This also includes the hydraulic drive 430 pushing the piston structure 440 towards the tank 402 to push the piston 434 up into the tank 402, helping to force the refrigerant 406 out of the tank 402. Electrical power is generated and stored and/or used at step 610. This could include, for example, the charging system 400 using the generator 408 to generate DC power based on the flow of refrigerant 406 between the tanks 402 and 404. The DC power can be provided to the power conditioner 314 and stored in the power storage 316 or used by the vehicle 300.

The transfer of the refrigerant eventually stops or is prevented, and at some point the vehicle rises to a higher depth at step 612. This could include, for example, the controller 302 of the vehicle 300 controlling the propulsion components 318 so that the vehicle 300 ascends to or near the surface of a body of water. Water is pushed out of the first hydraulic drive at step 614. This could include, for example, the charging system 400 pulling warmer water into the water jackets 410 and 412. This could also include the warmer water or a warmer ambient temperature heating the refrigerant 406 in the tank 402, causing the refrigerant 406 to expand and push the water 446 out of the hydraulic drive 430 through the valve 448*a*. This causes the pistons of the charging system to be placed in substantially equal positions at the higher depth at step 616.

At this point, the process repeats with the tanks and water jackets reversed. The underwater vehicle dives to a lower depth at step 618. The refrigerant is caused to flow from the second tank through a generator and into the first tank at step 620. This could include, for example, the charging system 400 pulling colder water into the water jacket 410 and opening the valves 418 and 420. This could also include the refrigerant 406 flowing from the tank 404 to the tank 402. A second valve of a second hydraulic drive is opened to drive a second piston in the second tank using water at step 622. This could include, for example, the charging system 400 opening the valve 448*b* to allow water 446 to enter the hydraulic drive 432. This also includes the hydraulic drive 432 pushing the piston structure 440 towards the tank 404 to push the piston 434 up into the tank 404, helping to force the refrigerant 406 out of the tank 404. Electrical power is generated and stored and/or used at step 624. This could include, for example, the charging system 400 using the generator 408 to generate DC power based on the flow of refrigerant 406 between the tanks 402 and 404. The DC power can be provided to the power conditioner 314 and stored in the power storage 316 or used by the vehicle 300.

At that point, the overall process can begin again by causing the underwater vehicle to ascend to a higher depth at step 626 and pushing the water out of the second hydraulic drive at step 628. This could include, for example, the charging system 400 pulling warmer water into the water jackets 410 and 412. This could also include the warmer water or a warmer ambient temperature heating the refrigerant 406 in the tank 402, causing the refrigerant 406 to expand and push the water 446 out of the channel 436 of the hydraulic drive 430 through the valve 448*b*. This causes the pistons of the charging system to be placed in substantially equal positions at the higher depth back at step 602.

This process can be repeated any number of times as the vehicle 300 ascends and descends in a body of water. The interval of time between ascending and descending can be fixed or variable and could vary based on a number of factors.

Although FIG. 6 illustrates one example of a method 600 for periodically charging an underwater vehicle, various changes may be made to FIG. 6. For example, while shown as a series of steps, various steps in FIG. 6 could overlap, occur in parallel, occur in a different order, or occur any number of times. As a particular example, steps 606-610 or steps 620-624 generally overlap during the production of electrical power.

Figure 7A:
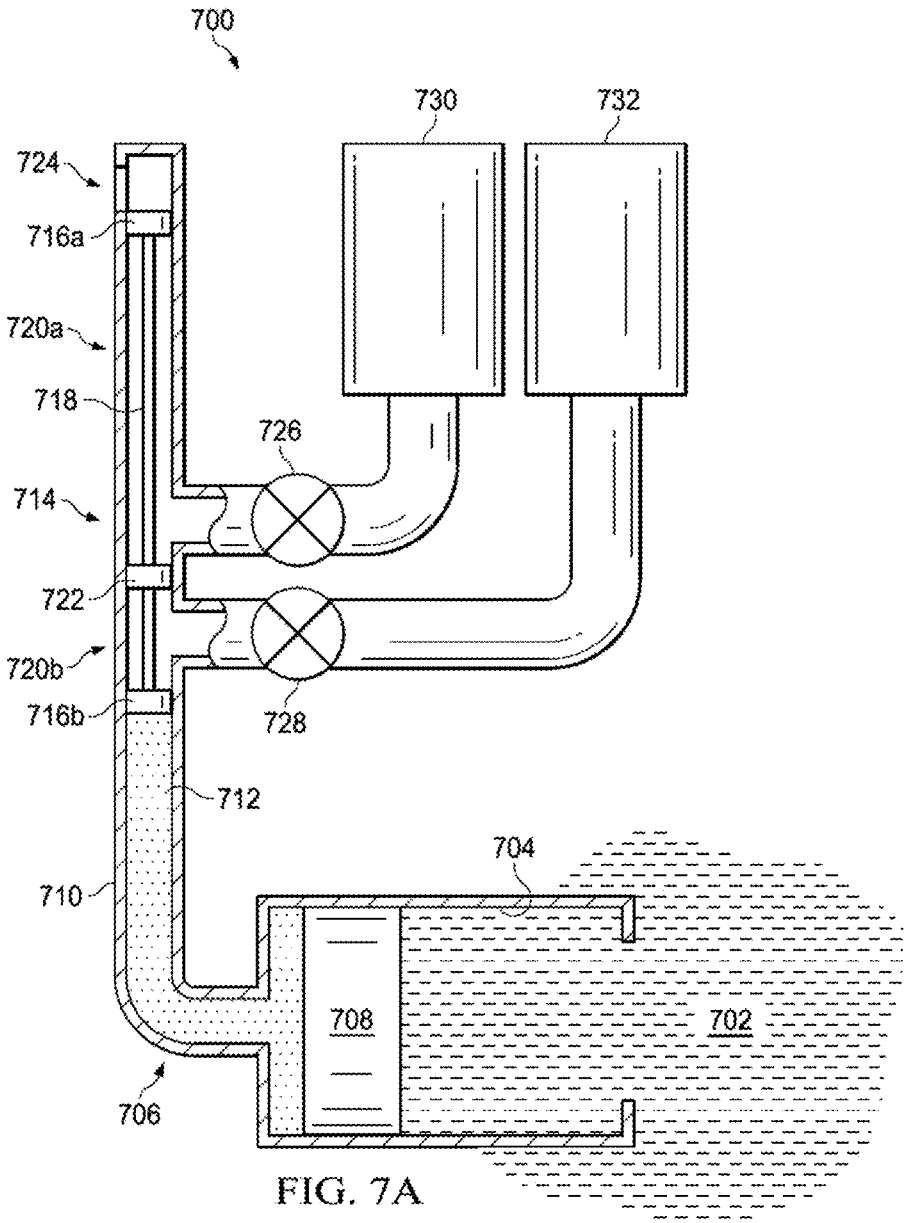
FIGS. 7A through 7C illustrate an example ballast system for an underwater vehicle in accordance with this disclosure.
Figure 7B:
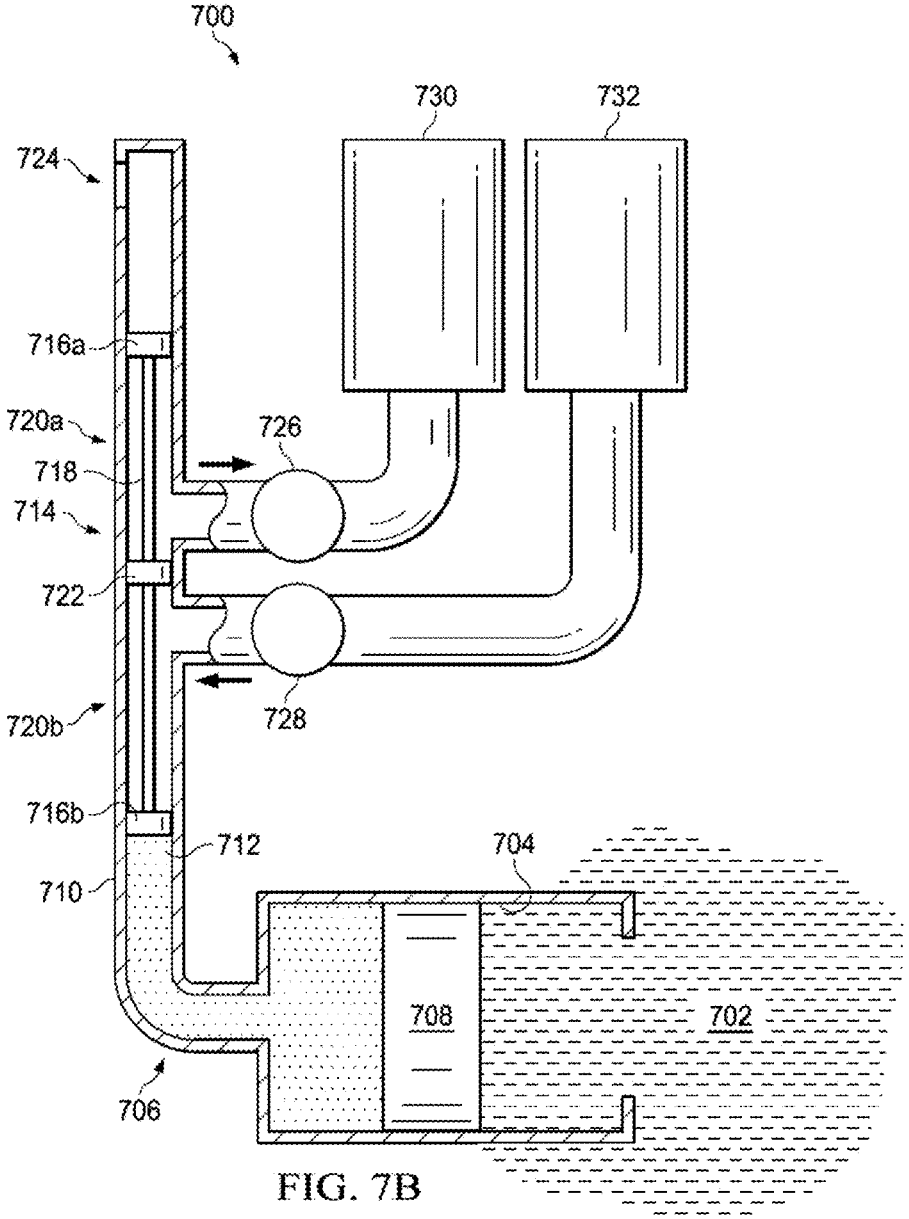
Figure 7C:
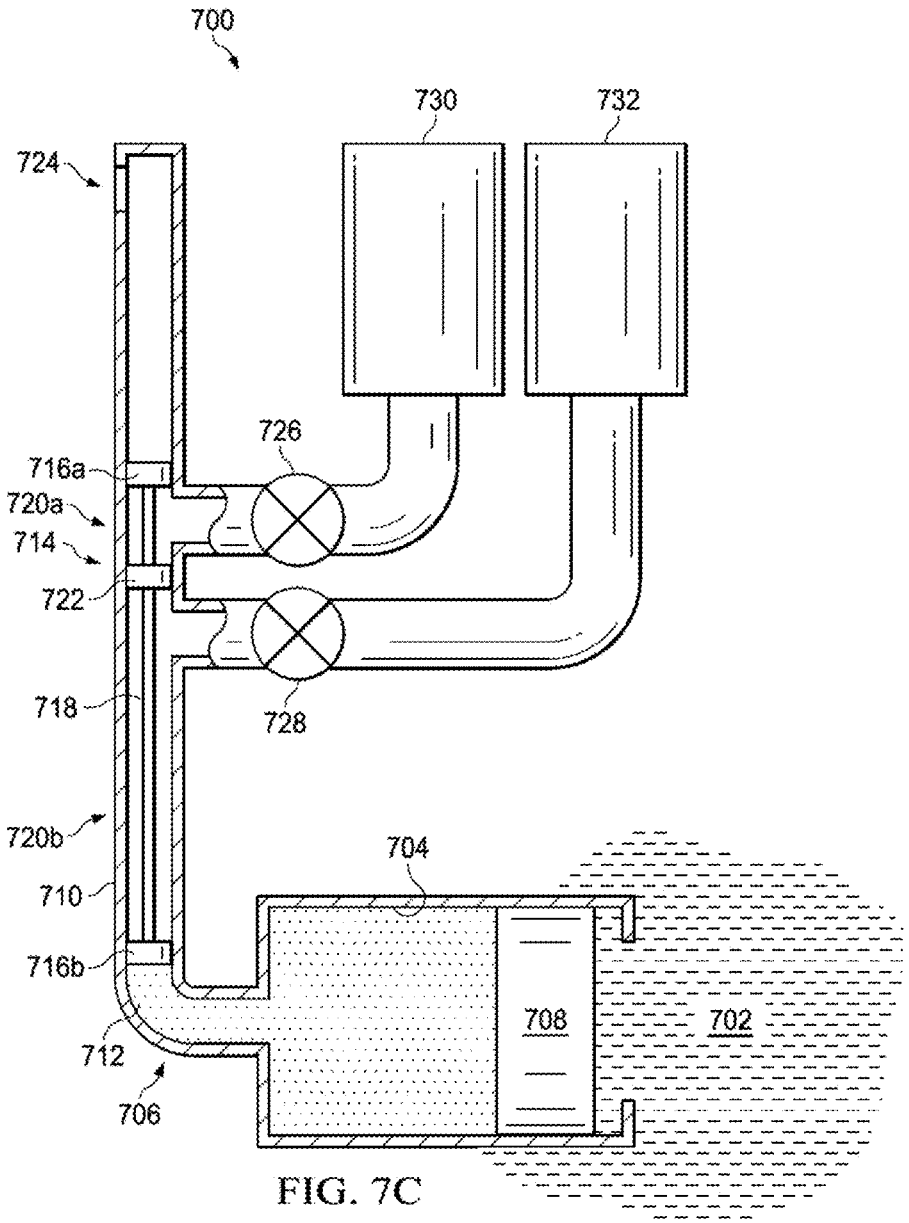

FIGS. 7A through 7C illustrate an example ballast system 700 for an underwater vehicle in accordance with this disclosure. This type of ballast system could, for example, be implemented as any of the ballasts 108*a*-108*b*, 208*a*-208*b*, although this type of ballast system could be used in any other suitable device or system.

As shown in FIGS. 7A through 7C, the ballast system 700 generally operates to pull variable amounts of water 702 into a cavity 704. The cavity 704 denotes any suitable structure configured to receive and hold fluid. This could be done to adjust an underwater vehicle's center of gravity, stabilize the underwater vehicle, or perform other functions.

A hydraulic drive 706 is used to adjust the amount of water 702 in the cavity 704. In this example, the hydraulic drive 706 includes a piston 708 that is positioned within the cavity 704 and that pushes the water 702 out of and pulls the water 702 into the cavity 704. The piston 708 can be sealed against the inner wall(s) of the cavity 704. The piston 708 denotes any suitable structure for moving within a cavity.

The hydraulic drive 706 also includes a channel 710 that contains a hydraulic fluid 712 and a movable piston structure 714. The channel 710 is fluidly coupled to the cavity 704 so that the hydraulic fluid 712 can move into and out of the cavity 704. The amount of hydraulic fluid 712 forced into the cavity 704 controls the position of the piston 708 within the cavity 704, thereby controlling the amount of water 702 in the cavity 704. The channel 710 denotes any suitable passageway configured to hold a hydraulic fluid. The hydraulic fluid 712 denotes any suitable material that can be used to apply force against a piston, such as an oil.

The movable piston structure 714 represents a structure that moves in order to increase or decrease the amount of hydraulic fluid 712 within the cavity 704. In this example, the movable piston structure 714 includes two small pistons 716*a*-716*b* attached by a connecting bar 718. An interior space between the pistons 716*a*-716*b* is divided into multiple pressure volumes 720*a*-720*b* by a separator 722. Each pressure volume 720*a*-720*b* denotes a space configured to receive a fluid (such as a gas or liquid) in order to move the piston structure 714. The separator 722 denotes any suitable structure for separating a space into different volumes.

An end portion of the channel 710 includes at least one vent 724. The vent 724 allows air within the end of the channel 710 to move into and out of channel 710 as the piston structure 714 moves. Each vent 724 includes an opening with any suitable size and shape, and any number and arrangement of vents can be used.

Valves 726 and 728 are fluidly coupled to the pressure volumes 720*a*-720*b* and to tanks 730 and 732. The tanks 730 and 732 can be used to provide fluid to or receive fluid from the pressure volumes 720*a*-720*b*. Typically, one of the tanks 730 and 732 functions as a source while another of the tanks 732 and 730 functions as a sink. These roles could be swapped over time, such as when the tanks 730 and 732 are implemented with water jackets that can receive warmer and colder water to alter the roles of the tanks 730 and 732. Each of the valves 726 and 728 includes any suitable structure for controlling a flow of fluid into and out of a pressure volume. Each of the tanks 730 and 732 includes any suitable structure for holding a gas or other fluid used to adjust a position of a movable piston structure. The tanks 730 and 732 may or may not represent the same tanks 402 and 404 used in a charging system 400.

In FIG. 7A, the movable piston structure 714 may be located at or near its top extreme position, so the pressure volume 720*a* has been expanded in size and the pressure volume 720*b* has been reduced in size. In FIG. 7B, the valves 726 and 728 have been opened, allowing fluid to flow from the tank 732 into the pressure volume 720*b*. A colder temperature or pressure of the tank 730 or movement of the piston structure 714 pushes fluid out of the pressure volume 720*a* into the tank 730. As a result, the piston structure 714 moves downward. The position in FIG. 7B could denote a neutral buoyance position of the ballast system 700. In FIG. 7C, the piston structure 714 may be located at or near its bottom extreme position, so the pressure volume 720*b* has been expanded in size and the pressure volume 720*a* has been reduced in size. A similar process could be repeated by pushing fluid into the pressure volume 720*a* and removing fluid from the pressure volume 720*b*, allowing the movable piston structure 714 to move back up. Note that the movable piston structure 714 could be controlled to stop at any desired location between its extreme positions.

The hydraulic drive 706 is used to control the amount of material in a defined space here. The same type of control mechanism used above in the charging system 400 can be used in the ballast system 700. The ballast system 700 therefore obtains a mechanical advantage using the hydraulic drive 706. For example, an advantage of 2:1 allows 700 PSI of pressure to be converted to 1,400 PSI of pressure by the piston 708 against the water 702, while an advantage of 3:1 allows 700 PSI of pressure to be converted to 2,100 PSI of pressure by the piston 708 against the water 702. This allows the ballast system 700 to use smaller amounts of pressure even when a vehicle is under elevated pressure at large depths. The mechanical advantage defined by the ratio X:1 indicates that the cavity 704 is X times wider than the channel 710 or that the cavity 704 has a cross-sectional area X times wider than a cross-sectional area of the channel 710 (where X is any whole or real number greater than one).

The type of system shown in FIGS. 7A through 7C could be used in various ways in an underwater vehicle. For example, the ballast system 700 provides a variable volume buoyancy system through the use of the hydraulic drive 706. Also, in some embodiments, the system 700 can have dual use as part of a topping cycle (with mechanical advantage) and a buoyancy system (also with mechanical advantage).

Although FIGS. 7A through 7C illustrate one example of a ballast system 700 for an underwater vehicle, various changes may be made to FIGS. 7A through 7C. For example, various components in FIGS. 7A through 7C could be combined, further subdivided, rearranged, or omitted or additional components could be added according to particular needs. Also, shapes, sizes, and dimensions of various components in FIGS. 7A through 7C could vary as needed or desired.

Figure 8:
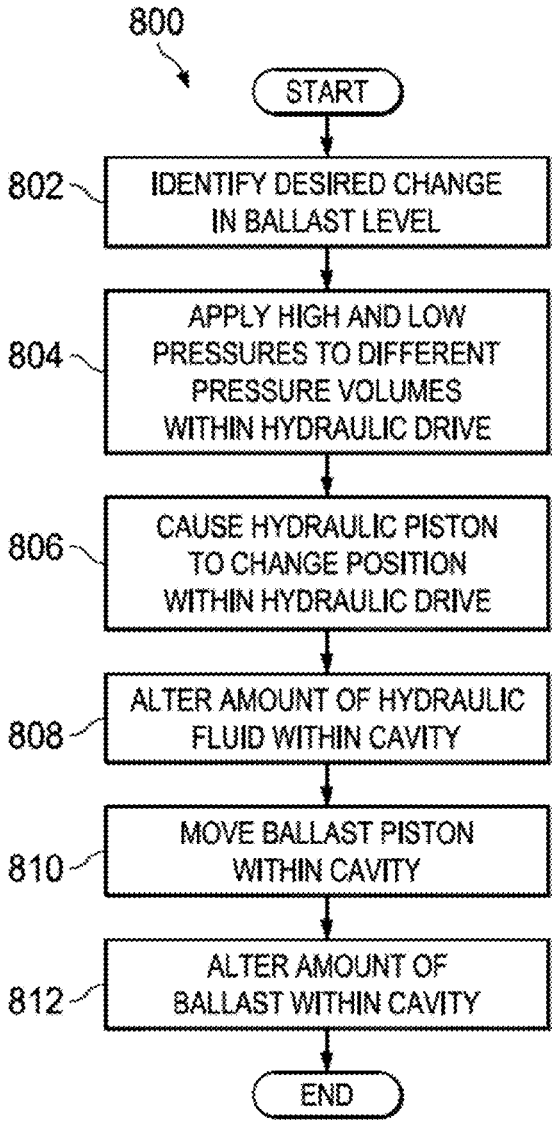
FIG. 8 illustrates an example method for stabilizing an underwater vehicle using a ballast system in accordance with this disclosure.

FIG. 8 illustrates an example method 800 for stabilizing an underwater vehicle using a ballast system in accordance with this disclosure. For ease of explanation, the method 800 is described with respect to the ballast system 700 operating in the vehicle 300. However, the method 800 could be used in any other suitable device or system.

As shown in FIG. 8 and referring to components described in FIGS. 7A through 7C, a desired change in a ballast level is identified at step 802. This could include, for example, the controller 302 of the vehicle 300 identifying whether more or less mass is needed or desired in the cavity 704 of the ballast system 700. This could be based on any suitable calculations, such as the vehicle's current depth or whether the vehicle 300 is traveling in a desired manner.

Higher and lower pressures are created in or applied to different pressure volumes within a hydraulic drive at step 804. This could include, for example, the ballast system 700 opening the valves 726 and 728 to allow fluid to flow into and out of the appropriate pressure volumes 720*a*-720*b*. This causes a hydraulic piston to change position within a cavity of a hydraulic drive at step 806. This could include, for example, the changes in pressure within the pressure volumes 720*a*-720*b* causing the movable piston structure 714 to move. This alters an amount of hydraulic fluid within the cavity at step 808, moves a ballast piston within the cavity at step 810, and alters an amount of ballast within the cavity at step 812. This could include, for example, the movable piston structure 714 altering an amount of the hydraulic fluid 712 within the cavity 704, moving the piston 708 within the cavity 704 and changing an amount of water 702 within the cavity 704.

Although FIG. 8 illustrates one example of a method 800 for stabilizing an underwater vehicle using a ballast system, various changes may be made to FIG. 8. For example, while shown as a series of steps, various steps in FIG. 8 could overlap, occur in parallel, occur in a different order, or occur any number of times. As a particular example, steps 804-812 generally overlap with one another.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. §112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. §112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the scope of this disclosure, as defined by the following claims.

What is claimed is:

1. An apparatus comprising:

first and second tanks each configured to receive and store a refrigerant under pressure;

at least one generator configured to receive flows of the refrigerant between the tanks and to generate electrical power based on the flows of the refrigerant; and first and second hydraulic drives associated with the first and second tanks, respectively, each hydraulic drive comprising:

a first piston within the associated tank;

a channel fluidly coupled to the associated tank and configured to contain hydraulic fluid; and a second piston within the channel and configured to move within the channel in order to vary an amount of the hydraulic fluid within the associated tank and vary a position of the first piston within the associated tank;

wherein the channel of each hydraulic drive has a cross-sectional area that is less than a cross-sectional area of the associated tank.

2. The apparatus of claim 1, wherein each hydraulic drive further comprises:

a valve fluidly coupled to the channel of the hydraulic drive and configured to allow water under pressure to enter the channel of the hydraulic drive and move the second piston within the channel of the hydraulic drive.

3. The apparatus of claim 2, wherein a controller is configured to control the valves of the hydraulic drives in order to:

during a first time period, open the valve of the first hydraulic drive to cause the first piston of the first hydraulic drive to push at least some of the refrigerant out of the first tank; and during a second time period, open the valve of the second hydraulic drive to cause the first piston of the second hydraulic drive to push at least some of the refrigerant out of the second tank.

4. The apparatus of claim 2, further comprising:

first and second insulated water jackets each configured to receive and retain water, the first tank located within the first insulated water jacket, the second tank located within the second insulated water jacket.

5. The apparatus of claim 4, wherein a controller is configured to control the valves of the hydraulic drives in order to:

during a first time period, keep the valve of the first hydraulic drive opened while warmer water in the first insulated water jacket causes the refrigerant in the first tank to expand and push water out of the channel of the first hydraulic drive; and during a second time period, keep the valve of the second hydraulic drive opened while warmer water in the second insulated water jacket causes the refrigerant in the second tank to expand and push water out of the channel of the second hydraulic drive.

6. The apparatus of claim 1, further comprising:

first and second insulated water jackets each configured to receive and retain water, the first tank located within the first insulated water jacket, the second tank located within the second insulated water jacket;

wherein the insulated water jackets are configured to receive and retain water of different temperatures to facilitate transport of the refrigerant from one of the tanks to another of the tanks.

7. The apparatus of claim 6, wherein a controller is configured to control valves of the insulated water jackets in order to:

during a first time period, cause the first insulated water jacket to receive warmer water, cause the second insulated water jacket to receive colder water, and cause the refrigerant to flow from the first tank to the second tank; and during a second time period, cause the first insulated water jacket to receive colder water, cause the second insulated water jacket to receive warmer water, and cause the refrigerant to flow from the second tank to the first tank.

8. The apparatus of claim 1, wherein a controller is configured to cause the refrigerant to repeatedly flow back and forth between the first and second tanks.

9. A system comprising:

an underwater vehicle comprising a body and fins projecting from the body;

the underwater vehicle also comprising a power generator comprising:

first and second tanks each configured to receive and store a refrigerant under pressure;

at least one generator configured to receive flows of the refrigerant between the tanks and to generate electrical power based on the flows of the refrigerant; and first and second hydraulic drives associated with the first and second tanks, respectively, each hydraulic drive comprising:

a first piston within the associated tank;

a channel fluidly coupled to the associated tank and configured to contain hydraulic fluid; and a second piston within the channel and configured to move within the channel in order to vary an amount of the hydraulic fluid within the associated tank and vary a position of the first piston within the associated tank;

wherein the channel of each hydraulic drive has a cross-sectional area that is less than a cross-sectional area of the associated tank.

10. The system of claim 9, wherein each hydraulic drive further comprises:

a valve fluidly coupled to the channel of the hydraulic drive and configured to allow water under pressure to enter the channel of the hydraulic drive and move the second piston within the channel of the hydraulic drive.

11. The system of claim 10, wherein the underwater vehicle further comprises a controller configured to control the valves of the hydraulic drives in order to:

during a first time period, open the valve of the first hydraulic drive to cause the first piston of the first hydraulic drive to push at least some of the refrigerant out of the first tank; and during a second time period, open the valve of the second hydraulic drive to cause the first piston of the second hydraulic drive to push at least some of the refrigerant out of the second tank.

12. The system of claim 10, wherein the power generator further comprises:

first and second insulated water jackets each configured to receive and retain water, the first tank located within the first insulated water jacket, the second tank located within the second insulated water jacket.

13. The system of claim 12, wherein the underwater vehicle further comprises a controller configured to control the valves of the hydraulic drives in order to:

during a first time period, keep the valve of the first hydraulic drive opened while warmer water in the first insulated water jacket causes the refrigerant in the first tank to expand and push water out of the channel of the first hydraulic drive; and during a second time period, keep the valve of the second hydraulic drive opened while warmer water in the second insulated water jacket causes the refrigerant in the second tank to expand and push water out of the channel of the second hydraulic drive.

14. The system of claim 9, wherein the power generator further comprises:

first and second insulated water jackets each configured to receive and retain water, the first tank located within the first insulated water jacket, the second tank located within the second insulated water jacket;

wherein the insulated water jackets are configured to receive and retain water of different temperatures to facilitate transport of the refrigerant from one of the tanks to another of the tanks.

15. The system of claim 14, wherein the underwater vehicle further comprises a controller configured to control valves of the insulated water jackets in order to:

during a first time period, cause the first insulated water jacket to receive warmer water, cause the second insulated water jacket to receive colder water, and cause the refrigerant to flow from the first tank to the second tank; and during a second time period, cause the first insulated water jacket to receive colder water, cause the second insulated water jacket to receive warmer water, and cause the refrigerant to flow from the second tank to the first tank.

16. The system of claim 9, wherein the body further comprises wings, the wings configured to be swept forward or backward depending on whether the underwater vehicle is ascending or descending.

17. An apparatus comprising:

a cavity configured to receive a material; and a hydraulic drive comprising:

a first piston within the cavity;

a channel fluidly coupled to the cavity and configured to contain hydraulic fluid; and a second piston within the channel and configured to move within the channel in order to vary an amount of the hydraulic fluid within the cavity, vary a position of the first piston within the cavity, and vary an amount of the material within the cavity;

wherein the channel of the hydraulic drive has a cross-sectional area that is less than a cross-sectional area of the cavity.

18. The apparatus of claim 17, wherein:

the second piston comprises multiple second pistons attached by a connecting bar;

a separator divides a space between the second pistons into first and second pressure volumes; and the apparatus further comprises first and second valves fluidly coupled to the first and second pressure volumes, respectively.

19. The apparatus of claim 18, wherein a controller is configured to control the first and second valves in order to:

during a first time period, increase pressure within the first pressure volume and decrease pressure within the second pressure volume to cause the first piston to move a first direction in the cavity; and during a second time period, decrease the pressure within the first pressure volume and increase the pressure within the second pressure volume to cause the first piston to move a second direction in the cavity.

20. The apparatus of claim 17, wherein the apparatus forms part of a ballast system configured to control an amount of water in the cavity in order to adjust a center of gravity of or stabilize an underwater vehicle.

* * * * *